US007052815B2

(12) United States Patent
Sawada et al.

(10) Patent No.: US 7,052,815 B2
(45) Date of Patent: May 30, 2006

(54) COLOR TONER FOR DEVELOPING ELECTROSTATIC IMAGES, TONER CONTAINER CONTAINING THE COLOR TONER, AND IMAGE FORMING METHOD AND APPARATUS USING THE COLOR TONER

(75) Inventors: Toyoshi Sawada, Odawara (JP); Masanori Suzuki, Suntoh-gun (JP); Kohki Katoh, Tokyo (JP); Yohichiroh Watanabe, Fuji (JP); Keiko Shiraishi, Susono (JP); Takuya Saito, Numazu (JP); Masashi Nagayama, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 100 days.

(21) Appl. No.: 10/444,013

(22) Filed: May 23, 2003

(65) Prior Publication Data

US 2003/0219670 A1 Nov. 27, 2003

(30) Foreign Application Priority Data

May 24, 2002 (JP) ..... 2002-151307

(51) Int. Cl.
*G03G 9/087* (2006.01)

(52) U.S. Cl. ..... 430/109.4; 430/110.1; 430/124

(58) Field of Classification Search ..... 430/110.1, 430/109.4, 124
See application file for complete search history.

(56) References Cited

U.S. PATENT DOCUMENTS

| | | | | |
|---|---|---|---|---|
| 5,380,616 | A * | 1/1995 | Aoki et al. | 430/110.1 |
| 6,168,894 | B1 | 1/2001 | Aoki et al. | |
| 6,258,502 | B1 | 7/2001 | Nakamura et al. | |
| 6,335,137 | B1 | 1/2002 | Suzuki et al. | |
| 6,363,229 | B1 | 3/2002 | Shiraishi et al. | |
| 6,468,706 | B1 | 10/2002 | Matsuda et al. | |
| 6,503,676 | B1 | 1/2003 | Yamashita et al. | |
| 6,544,704 | B1 | 4/2003 | Matsuda et al. | |
| 6,852,459 | B1 | 2/2005 | Katoh et al. | |
| 2003/0129518 | A1* | 7/2003 | Sawada et al. | 430/110.1 |
| 2003/0165759 | A1* | 9/2003 | Suzuki et al. | 430/110.1 |
| 2003/0165760 | A1* | 9/2003 | Higuchi et al. | 430/110.1 |
| 2005/0008961 | A1 | 1/2005 | Takada et al. | |

FOREIGN PATENT DOCUMENTS

| | | |
|---|---|---|
| EP | 1 126 324 | 8/2001 |
| EP | 1 168 089 | 1/2002 |
| JP | 60-90344 | 5/1985 |
| JP | 62-63940 | 3/1987 |
| JP | 64-15755 | 1/1989 |
| JP | 2-82267 | 3/1990 |
| JP | 3-41470 | 2/1991 |
| JP | 3-229264 | 10/1991 |
| JP | 2931899 | 9/1999 |
| JP | 11-305486 | 11/1999 |
| JP | 2001-222138 | 8/2001 |

OTHER PUBLICATIONS

U.S. Appl. No. 10/314,241, filed Dec. 9, 2002, Saito, et al.
U.S. Appl. No. 10/251,855, filed Sep. 23, 2002, Sawada, et al.
U.S. Appl. No. 10/268,830, filed Oct. 11, 2002, Nakazato, et al.
U.S. Appl. No. 10/305,191, filed Nov. 27, 2002, Uchinokura, et al.
U.S. Appl. No. 10/282,039, filed Oct. 29, 2002, Ogiyama, et al.
U.S. Appl. No. 10/163,530, filed Jun. 7, 2002, Shiraishi, et al.
U.S. Appl. No. 10/212,736, filed Aug. 7, 2002, Sugiura, et al.
U.S. Appl. No. 10/284,177, filed Oct. 31, 2002, Tomita, et al.
U.S. Appl. No. 10/176,578, filed Jun. 24, 2002, Niimi, et al.
U.S. Appl. No. 10/158,069, filed May 31, 2002, Matsuda, et al.
U.S. Appl. No. 10/114,056, filed Apr. 3, 2002, Fushimi, et al.
U.S. Appl. No. 10/178,685, filed Jun. 25, 2002, Sugino, et al.
U.S. Appl. No. 10/200,178, filed Jul. 23, 2002, Tamiya, et al.
U.S. Appl. No. 10/193,219, filed Jul. 12, 2002, Takahashi, et al.
U.S. Appl. No. 10/102,629, filed Mar. 22, 2002, Sawada, et al.
U.S. Appl. No. 10/151,103, filed May 21, 2002, Kondo, et al.
U.S. Appl. No. 10/153,627, filed May 24, 2002, Suzuki, et al.
U.S. Appl. No. 10/077,752, filed Feb. 20, 2002, Iwamoto, et al.
U.S. Appl. No. 10/098,556, filed Mar. 18, 2002, Emoto, et al.
U.S. Appl. No. 10/020,925, filed Dec. 19, 2001, Mochizuki, et al.
U.S. Appl. No. 10/086,683, filed Mar. 4, 2002, Matsuda, et al.

(Continued)

*Primary Examiner*—Christopher RoDee
(74) *Attorney, Agent, or Firm*—Oblon, Spivak, McClelland, Maier & Neustadt, P.C.

(57) ABSTRACT

A color toner including toner particles including a colorant, a binder resin, and a wax; and an external additive including at least one of an inorganic particulate material and a particulate resin, wherein the binder resin includes a polyester resin (A) having a crystallinity and a formula $(—O—CO—CR1{=}CR2\text{-}CO—O—(CH_2)_n—)_m$, wherein R1 and R2 independently represents a hydrocarbon, and n and m are repeating numbers; a resin (B); and a resin (C), wherein the resins (B) and (C) and the wax have an island-sea structure such that the resin (C) is present like islands in a sea of the resin (B) and the wax is substantially included in the resin (C). A toner container, an image forming method, an image forming apparatus and a process cartridge including the color toner are also provided.

18 Claims, 6 Drawing Sheets

OTHER PUBLICATIONS

U.S. Appl. No. 09/988,142, filed Nov. 19, 2001, Kotsugai, et al.
U.S. Appl. No. 09/993,606, filed Nov. 27, 2001, Kotsugai, et al.
U.S. Appl. No. 10/101,756, filed Mar. 21, 2002, Matsuda, et al.
U.S. Appl. No. 10/077,813, filed Feb. 20, 2002, Matsuda, et al.
U.S. Appl. No. 10/059,240, filed Jan. 31, 2002, Sugiura, et al.
U.S. Appl. No. 09/820,609, filed Mar. 30, 2001, Higuchi, et al.
U.S. Appl. No. 09/996,585, filed Nov. 30, 2001, Higuchi, et al.
U.S. Appl. No. 09/982,877, filed Oct. 22, 2001, Matsuda, et al.
U.S. Appl. No. 09/964,622, filed Sep. 28, 2001, Nanya, et al.
U.S. Appl. No. 09/965,826, filed Oct. 1, 2001, Higuchi, et al.
U.S. Appl. No. 10/674,358, filed Oct. 1, 2003, Sugiyama, et al.
U.S. Appl. No. 10/670,320, filed Sep. 26, 2003, Watanabe, et al.
U.S. Appl. No. 10/647,346, filed Aug. 26, 2003, Suzuki, et al.
U.S. Appl. No. 10/666,254, filed Sep. 22, 2003, Kondo et al.
U.S. Appl. No. 10/712,026, filed Nov. 14, 2003, Tomita et al.
U.S. Appl. No. 10/706,113, filed Nov. 13, 2003, Tanaka, et al.
U.S. Appl. No. 10/759,197, filed Jan. 20, 2004, Emoto et al.
U.S. Appl. No. 10/772,435, filed Feb. 6, 2004, Shiraishi, et al.
U.S. Appl. No. 10/802,866, filed Mar. 18, 2004, Saito, et al.
U.S. Appl. No. 10/802,887, filed Mar. 18, 2004, Tanaka, et al.
U.S. Appl. No. 10/804,084, filed Mar. 19, 2004, Takada et al.
U.S. Appl. No. 10/804,082, filed Mar. 19, 2004, Tanaka, et al.
U.S. Appl. No. 10/800,636, filed Mar. 16, 2004, Hasegawa, et al.
U.S. Appl. No. 10/875,402, filed Jun. 25, 2004, Sugiura et al.
U.S. Appl. No. 10/910,764, filed Aug. 4, 2004, Inoue et al.
U.S. Appl. No. 10/912,230, filed Aug. 6, 2004, Katoh, et al.
U.S. Appl. No. 10/960,084, filed Oct. 8, 2004, Yamada, et al.
U.S. Appl. No. 10/959,663, filed Oct. 7, 2004, Sugiura, et al.
U.S. Appl. No. 10/977,013, filed Nov. 1, 2004, Yamaguchi et al.
U.S. Appl. No. 11/081,737, filed Mar. 17, 2005, Matsumoto, et al.
U.S. Appl. No. 11/108,646, filed Apr. 19, 2005, Sawada et al.

* cited by examiner

COLOR TONER FOR DEVELOPING ELECTROSTATIC IMAGES, TONER CONTAINER CONTAINING THE COLOR TONER, AND IMAGE FORMING METHOD AND APPARATUS USING THE COLOR TONER

BACKGROUND OF THE INVENTION

1. Field of the Invention

The present invention relates to a color toner for use in developing electrostatic images formed by a method such as electrophotography, electrostatic recording and electroprinting. In addition, the present invention also relates to a toner container containing the toner, a process cartridge using the toner, and an image forming apparatus and an image forming method using the toner.

2. Discussion of the Background

Electrophotographic image forming methods typically include the following processes:

(1) an electrostatic latent image is formed on an image bearing member (electrostatic latent image forming process);

(2) the electrostatic latent image is developed with a charged toner to form a visual toner image on the image bearing member (developing process);

(3) the toner image is transferred onto a receiving material optionally via an intermediate transfer medium (transfer process); and (4) the toner image on the receiving material is fixed upon application of heat, pressure and/or a solvent thereto, resulting in outputting of a hard copy (fixing process).

Recently, not only electrophotographic monochrome copiers and printers but also electrophotographic full color copiers and printers are commercialized. It is considered that the market of the electrophotographic full color copiers and printers will become active more and more.

Color images are typically formed by overlaying three primary color toner images (i.e., a yellow toner image, a magenta toner image and a cyan toner image) and a black toner image. In order to form a color image having good color reproducibility and clearness, the fixed color toner image preferably has a smooth surface to some extent to avoid excessive light scattering on the color image. Therefore, color images produced by conventional full color copiers typically have a medium gloss of from 10% to 50%.

In general, contact heating fixing methods in which a dry toner image is fixed on a receiving material upon application of heat thereto using a heat fixing member having a smooth surface, such as heated rollers and belts, are typically used as the toner image fixing method. These methods have advantages such that the heat efficiency is high and high speed fixing can be performed, thereby imparting high gloss and transparency to the toner image. However, since the melted toner is brought into contact with the heat fixing member upon application of pressure thereto and then the toner is peeled from the heat fixing member, the methods tend to cause an offset problem in that a part of the toner image on a receiving material is transferred to the surface of the heating member and is then re-transferred onto other images, resulting in deterioration of image qualities.

In attempting to avoid such an offset problem, fixing methods in which a layer of a material having good releasability such as silicone rubbers and fluorine containing resins is formed on the surface of the heat fixing member and in addition a release agent such as silicone oils is applied to the surface of the heat fixing member have been used. These fixing methods are effective at preventing occurrence of the offset problem, but a device applying a release agent has to be provided, resulting in increase in size of the fixing device and increase of manufacturing costs of the fixing device.

Recently, fixing methods in which no release oil or a very small amount of a release oil is applied to a heat fixing member have been used while using a monochrome toner which has a high melt viscoelasticity by controlling the molecular weight distribution of the binder resin to prevent internal breaking of the toner and which includes a release agent such as waxes.

However, as mentioned above, color toners have to have a low melt viscoelasticity to smooth the surface of the resultant color toner images (i.e., to impart good color reproducibility to the resultant color toner images). Therefore, color toners tend to cause the offset problem compared to monochrome toners because the monochrome toner images having a low gloss do not cause any problem. Therefore, it is hard to use an oil-free fixing device or a fixing device in which a small amount of oil is applied to a heat fixing member for color copiers using color toners.

In addition, when a release agent is added to a toner, the following problems tend to occur (1) the toner has a large adhesion on the image bearing member and therefore the transfer ratio of toner images transferred from the image bearing member to a receiving material decreases; and (2) the release agent included in the toner contaminates the frictional-charging members such as carriers of the toner, resulting in deterioration of charging properties of the charging members, i.e., deterioration of durability of the charging members.

Conventionally, resins such as polyester resins and epoxy resins have been used as binder resins for color toners because the resultant toners can produce images having a high gloss even when the resins have a low molecular weight. However, such resins have a drawback such that the charges of the resultant toners largely change when environmental humidity changes. This is because the resins have a hydrophilic group therein. In addition, it is a recent trend that toner particles are miniaturized to produce high quality images. In this regard, polyester resins and epoxy resins have poorer pulverizability than styrene resins which have been typically used as binder resins for monochrome toners.

In attempting to provide a toner which can exhibit a good combination of pulverizability, transferability, durability and charge stability and which does not cause an offset problem even when used in fixing methods in which no release oil or a small amount of release oil is applied to a fixing member, the following toners have been proposed:

(1) a toner including a linear polyester resin having a softening point of from90 to 120° C. and a carnauba wax (Published Unexamined Japanese Patent Application No. (hereinafter referred to as JP-A) 08-220808);

(2) a toner including a resin and a wax which are mixed with each other and which have different softening points (JP-A 09-106105);

(3) a toner including a polyester resin having a specific melt viscosity and a wax having a specific melt viscosity (JP-A 09-304964);

(4) a toner including a polyester resin having a softening point of from 90 to 120° C., a rice wax, a carnauba wax and a silicone oil (JP-A 10-293425); and (5) a polymerized toner in which a wax is included in a resin particle (JP-A 05-61242).

However, these toners are not a toner which can exhibit a good combination of pulverizability, transferability, durability and charge stability and which does not cause an offset problem even when used in fixing methods in which no release oil or a small amount of release oil is applied to a fixing member.

Recently, the fixing temperature of fixing devices is decreased to save energy, namely, the energy applied to a toner image during the fixing process decreases. Therefore, it is essential for a toner to have a low temperature fixability so as to be used for low temperature fixing devices. In order to provide a toner having a low fixable temperature, the thermal properties of the binder resin used in the toner has to be controlled. However, when a resin having too low a glass transition temperature (Tg) is used as a binder resin, the high temperature preservability of the resultant toner deteriorates. When the $F_{1/2}$ temperature of a resin, which is defined as the mid-temperature of the flow-starting temperature and the flow-ending temperature, is excessively decreased by decreasing the molecular weight of the resin, problems such that the lower limit of the hot offset temperature range decreases and in addition the gloss of the resultant images seriously increases occur. Namely, a toner which has a good low temperature fixability and a high hot offset temperature and which can produce images having a proper gloss cannot be provided by merely controlling the thermal properties of the binder resin used.

In attempting to improve the low temperature fixability, JP-As 60-90344, 64-15755, 02-82267, 03-229264, 03-41470 and 11-305486 have disclosed techniques such that a polyester resin having a good low temperature fixability and a fair high temperature preservability is used as a binder resin. Further in attempting to improve the low temperature fixability, JP-A 62-63940 discloses a technique such that a specific non-olefin crystalline polymer which sharply melts at its glass transition temperature is included in the binder resin. However, the toners prepared by these techniques are not a toner which can exhibit a good combination of pulverizability, transferability, durability and charge stability and which does not cause an offset problem even when used in fixing methods in which no release oil or a small amount of release oil is applied to a fixing member.

Japanese patent No. 2,931,899 and JP-A 2001-222138 have disclosed techniques such that a crystalline polyester resin having a sharp-melting property is used as the binder resin. In the technique disclosed in JP 2,931,899, the acid value and hydroxyl value are as low as not greater than 5 and not greater than 20, respectively. Therefore the polyester resin has poor affinity for receiving papers, and thereby a good low temperature fixability cannot be imparted to the resultant toner. In addition, the molecular structure and molecular weight of the crystalline polyester resins are not optimized. Therefore, a toner which has a good low temperature fixability and good offset preventing property even when used for fixing devices in which no release oil or a very small amount of a release oil is applied to a fixing element and which has good transferability, good durability, good charge stability (i.e., little charge dependence on humidity), and good pulverizability is not provided.

By using the technique disclosed in JP-A 2001-222138, a toner which has a good low temperature fixability and good offset preventing property even when used for fixing devices in which no release oil or a very small amount of release oil is applied to a fixing element and which has good transferability, good durability, good charge stability (i.e., the dependence of the charge quantity of the toner on humidity is little), and good pulverizability cannot be provided.

Because of these reasons, a need exists for such a toner as having a good combination of the above-mentioned properties.

SUMMARY OF THE INVENTION

Accordingly, an object of the present invention is to provide a color toner which has a good low temperature fixability and can produce images having a proper gloss without causing the offset problem even when used for fixing devices in which no release oil or a very small amount of release oil is applied to a fixing element and which has good transferability, good durability, good charge stability under various humidity conditions, and good pulverizability.

Another object of the present invention is to provide a toner container and a color image forming method and apparatus by which color images having good image qualities can be stably produced for a long period of time with hardly causing the offset problem.

Briefly these objects and other objects of the present invention as hereinafter will become more readily apparent can be attained by a color toner including:

toner particles including:

a colorant;

a binder resin; and a wax, and an external additive including at least one of an inorganic particulate material and a particulate resin, wherein the binder resin includes:

a polyester resin (A) having a crystallinity and the following formula (1):

$$(\text{—O—CO—CR1=CR2—CO—O—}(CH_2)_n\text{—})_m \quad (1)$$

wherein R1 and R2 independently represents a hydrocarbon, and n and m are repeating numbers;

a resin (B); and a resin (C), wherein each of the resins (A), (B) and (C) and the wax is insoluble in the others, wherein the resins (B) and (C) and the wax have an island-sea structure such that the resin (C) is present like an island in a sea of the resin (B) and the wax is substantially included in the resin (C).

The resin (B) preferably has a weight average molecular weight of from 10,000 to 90,000, which is measured by a GPC (Gel Permeation Chromatography) method.

The resin (B) preferably include at least one of a polyester resin and a polyol resin.

The resin (C) preferably has a weight average molecular weight of from 10,000 to 60,000, which is measured by a GPC method.

The resin (C) is preferably a wax, on which a vinyl resin is grafted.

It is preferable that the wax dispersed in the toner has a maximum long axis particle diameter not less than 0.5 μm and not greater than ⅓ of a maximum particle diameter of the toner.

The wax preferably has a melting point of from 70 to 125° C. and a penetration not greater than 5 mm.

The toner particles preferably include at least one of an inorganic particulate material and a particulate resin as an internal additive.

It is preferable that the polyester resin (A) is included in the toner in an amount of from 1 to 50% by weight based on the total weight of the toner.

The polyester resin (A) preferably has a glass transition temperature of from 80 to 130° C. and a $F_{1/2}$ temperature of from 80 to 130° C.

The polyester resin (A) preferably includes an alcohol unit obtained from a diol having 2 to 6 carbon atoms and an acid unit obtained from an acid selected from the group consisting of maleic acid, fumaric acid, succinic acid and derivatives thereof.

The diol is preferably one of 1,4-butane diol, 1,6-hexane diol and derivatives of 1,4-butane diol and 1,6-hexane diol.

The polyester resin (A) preferably has an acid value of from 20 to 45 mgKOH/g, and/or a hydroxyl value of from 5 to 45 mgKOH/g.

The polyester resin (A) preferably has an X-ray diffraction spectrum in which a diffraction peak is observed at Bragg (2θ) angles of from 19° to 20°, from 21° to 22°, from 23° to 25° and from 29 to 31°.

The polyester resin (A) preferably has a weight average molecular weight (Mw) of from 5,500 to 6,500, a number average molecular weight (Mn) of from 1,300 to 1,500, and a ratio (Mw/Mn) of from 2 to 5.

As another aspect of the present invention, a toner container containing the toner of the present invention is provided.

As yet another aspect of the present invention, an image forming method is provided which includes the step of developing an electrostatic latent image on an image bearing member with the toner of the present invention to form a toner image thereon; and transferring the toner image on a receiving material.

As a further aspect of the present invention, an image forming apparatus is provided which includes an image bearing member configured to bear an electrostatic latent image thereon, and a developing device configured to develop the electrostatic latent image with a developer including the toner of the present invention.

As a still further aspect of the present invention, a process cartridge is provided which includes a container containing the toner of the present invention and at least one of a developing device configured to develop an electrostatic latent image on an image bearing member with a developer including the toner of the present invention, a charger configured to charge the image bearing member and a cleaner configured to clean the surface of the image bearing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
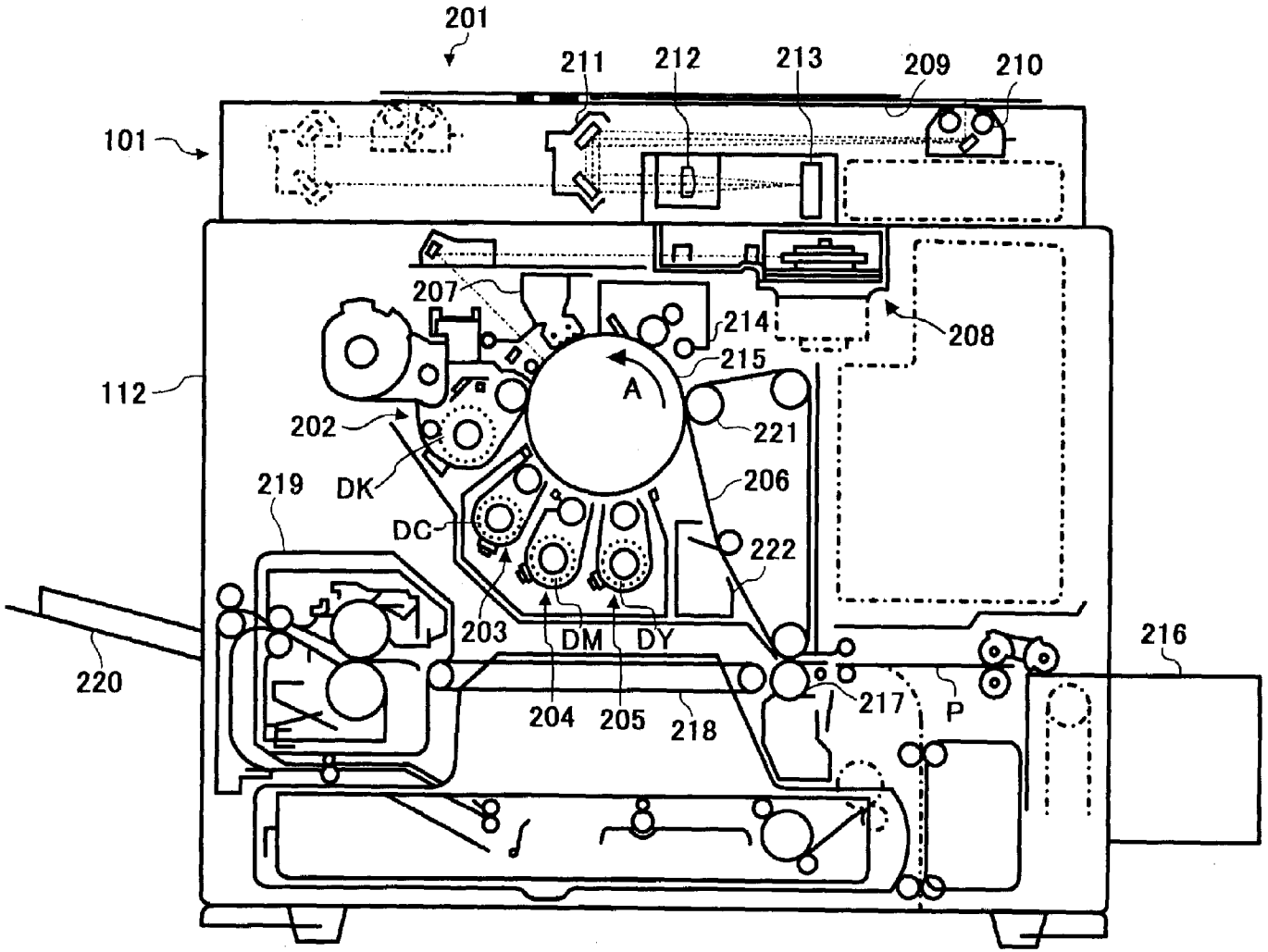
FIG. 1 is a schematic view illustrating the cross section of an embodiment of the image forming apparatus of the present invention.

The present inventors have investigated to solve the above-mentioned problems. As a result, it is found that a toner, which includes three or more kinds of resins having specific properties and a wax and in which the resins and wax have a specific phase separation structure, can solve the problems.

This invention is based on the discover such that it is effective at improving the low temperature fixability of a toner to use an aliphatic polyester resin, which has a crystallinity and which has a sharp molecular weight distribution while including low molecular weight fractions in an amount as much as possible, as the polyester (A) serving as the binder resin of the toner.

When such a low molecular weight aliphatic polyester resin is used as the polyester (A), the polyester resin (A) induces crystal transition at the glass transition temperature (Tg) thereof, and in addition rapidly melts (i.e., rapidly changes the phase from a solid state to a liquid state). Further, the polyester resin achieving the liquid state has a low melt viscosity, and therefore the resultant toner has good fixability to a receiving paper.

Therefore, by controlling the glass transition temperature (Tg) and $F_{1/2}$ temperature of the polyester resin (A), the lower limit of the fixable temperature range of the toner can be decreased while the toner maintains good offset resistance and the resultant toner images have a proper gloss. In addition, by controlling the glass transition temperature (Tg) and the $F_{1/2}$ temperature of the polyester resin (A) so as to be fall into a range of from 80 to 130° C., the resultant toner exhibits a good combination of high-temperature preservability, low temperature fixability and hot offset resistance while the resultant toner images have a proper gloss.

The $F_{1/2}$ temperature of a resin is defined as a temperature which is determined as the mid-temperature of the flow starting temperature and flow ending temperature of the resin when the resin is subjected to a heat analysis using a flow tester. The details of the measurements are described later.

The present inventors have investigated polyester resins while changing their molecular structure, molecular weight, glass transition temperature and $F_{1/2}$ temperature. As a result, it is found that with respect to the molecular structure polyester resins which include an alcohol unit obtained from a diol having 2 to 6 carbon atoms, such as 1,4-butane diol 1,6-hexanediol and their derivatives, and an acid unit obtained from an acid such as maleic acid, fumaric acid, succinic acid and their derivatives and which have the formula (1) mentioned below are preferably used as the polyester resin (A) in view of the crystallinity and softening point.

$$(\text{—O—CO—CR1=CR2—CO—O—}(CH_2)_n\text{—})_m \quad (1)$$

wherein R1 and R2 independently represent a hydrocarbon group, and each of n and m is the number of the repeating unit.

In addition, non-linear polyester resins which are prepared by performing condensation polymerization using an alcohol component including a polyhydric alcohol (i.e., alcohols having 3 or more hydroxyl groups) such as glycerin and a polybasic carboxylic acid (i.e., carboxylic acids having 3 or more carboxyl groups) such as trimellitic anhydride can also be used as the polyester resin (A) in view of the crystallinity and softening point.

The molecular structure of a polyester resin can be determined using solid C13-NMR (Nuclear Magnetic Resonance)

With respect to molecular weight, it is found that when a low molecular weight polyester resin having a sharp molecular weight distribution is used as the polyester resin (A), the resultant toner has good low temperature fixability. As a result of the present inventors' investigation, it is found that polyester resins having the following properties are preferable.

Namely, when the molecular weight distribution of the resin (A) is measured by subjecting the o-dichlorobenzene-soluble components of the resin to a GPC (Gel Permeation Chromatography) analysis while describing a molecular weight distribution curve by plotting log (M) (i.e., logarithm of the molecular weight of a fraction) on the horizontal axis and a content (in units of percent by weight) of the fraction on the vertical axis, a peak is preferably observed at a position between 3.5 and 4.0; the half width of the peak is preferably not greater than 1.5; the weight average molecular weight (Mw) thereof is preferably from 5,500 to 6,500; the number average molecular weight (Mn) thereof is preferably from 1,300 to 1,500; and the ratio (Mw/Mn) is preferably from 2 to 5.

In addition, it is found that the glass transition temperature and the $F_{1/2}$ temperature are as low as possible unless the high-temperature preservability of the resultant toner does not deteriorate. Specifically, the glass transition temperature and the $F_{1/2}$ temperature are preferably from 80 to 130° C. When the glass transition temperature and the $F_{1/2}$ temperature are too low, the high-temperature preservability of the resultant toner deteriorates. To the contrary, when the temperatures are too high, the lower limit of the fixable temperature range of the resultant toner increases, resulting in deterioration of the low temperature fixability of the toner.

The polyester resin (A) preferably has an acid value not less than 8 mgKOH/g, and more preferably not less than 20 mgKOH/g to impart good affinity for papers to the resultant toner, i.e., to impart good low temperature fixability to the resultant toner. On the other hand, in order to impart good hot offset resistance to the resultant toner, the acid value of the polyester resin (A) is preferably not greater than 45 mgKOH/g.

In addition, the polyester resin (A) preferably has a hydroxyl value of from 0 to 50 mgKOH/g, and more preferably from 5 to 50 mgKOH/g to impart good low temperature fixability and good charging properties to the resultant toner.

Whether or not the polyester resin (A) has crystallinity can be determined by subjecting the resin to an X-ray diffraction analysis for powder. If there are diffraction peaks at Bragg (2θ) angles of from 19° to 20°, from 21° to 22°, from 23° to25°, and from 29° to 31°, the resin has crystallinity. In addition, it can be determined by subjecting the resin to a DSC analysis. When an endothermic peak (a top peak) is observed at a temperature of from 80 to 130° C., it can be said that the resin has crystallinity.

Figure 2:
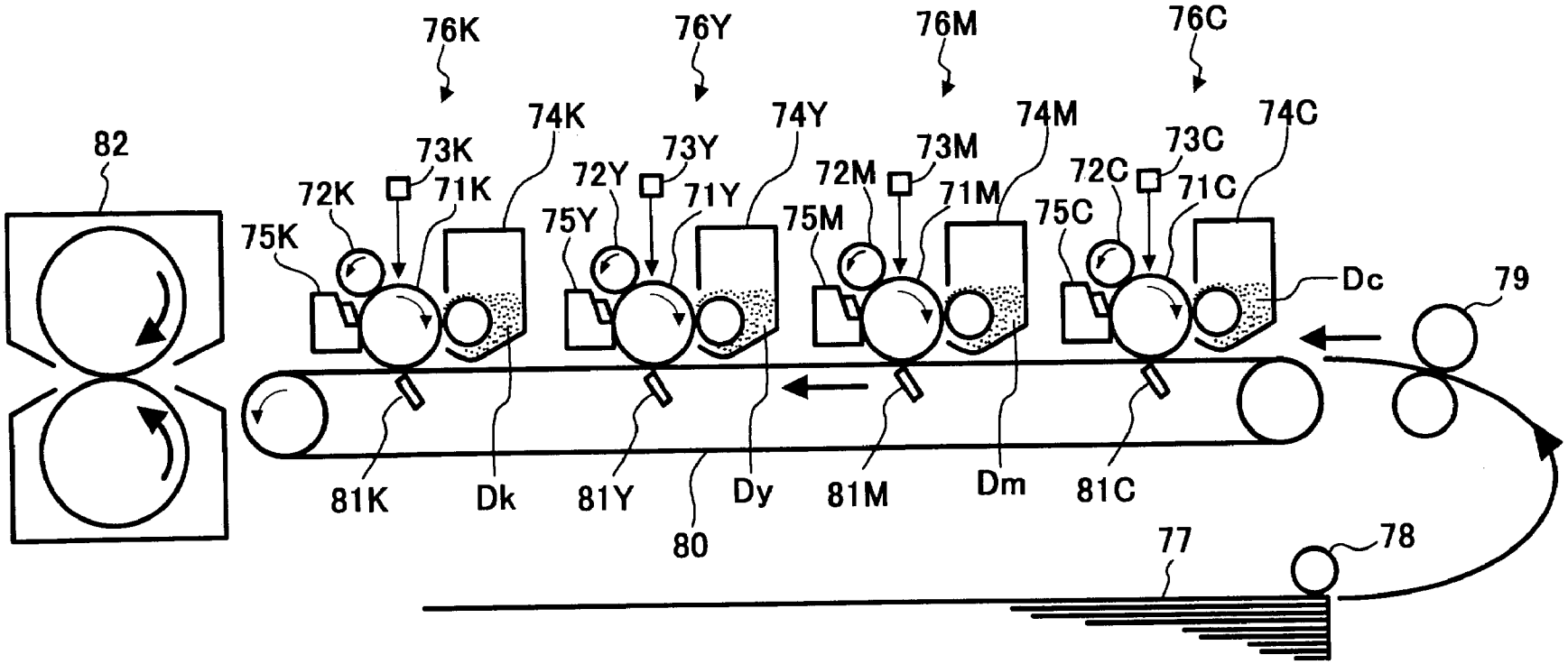
FIG. 2 is a schematic view illustrating the cross section of another embodiment of the image forming apparatus of the present invention.
Figure 3:
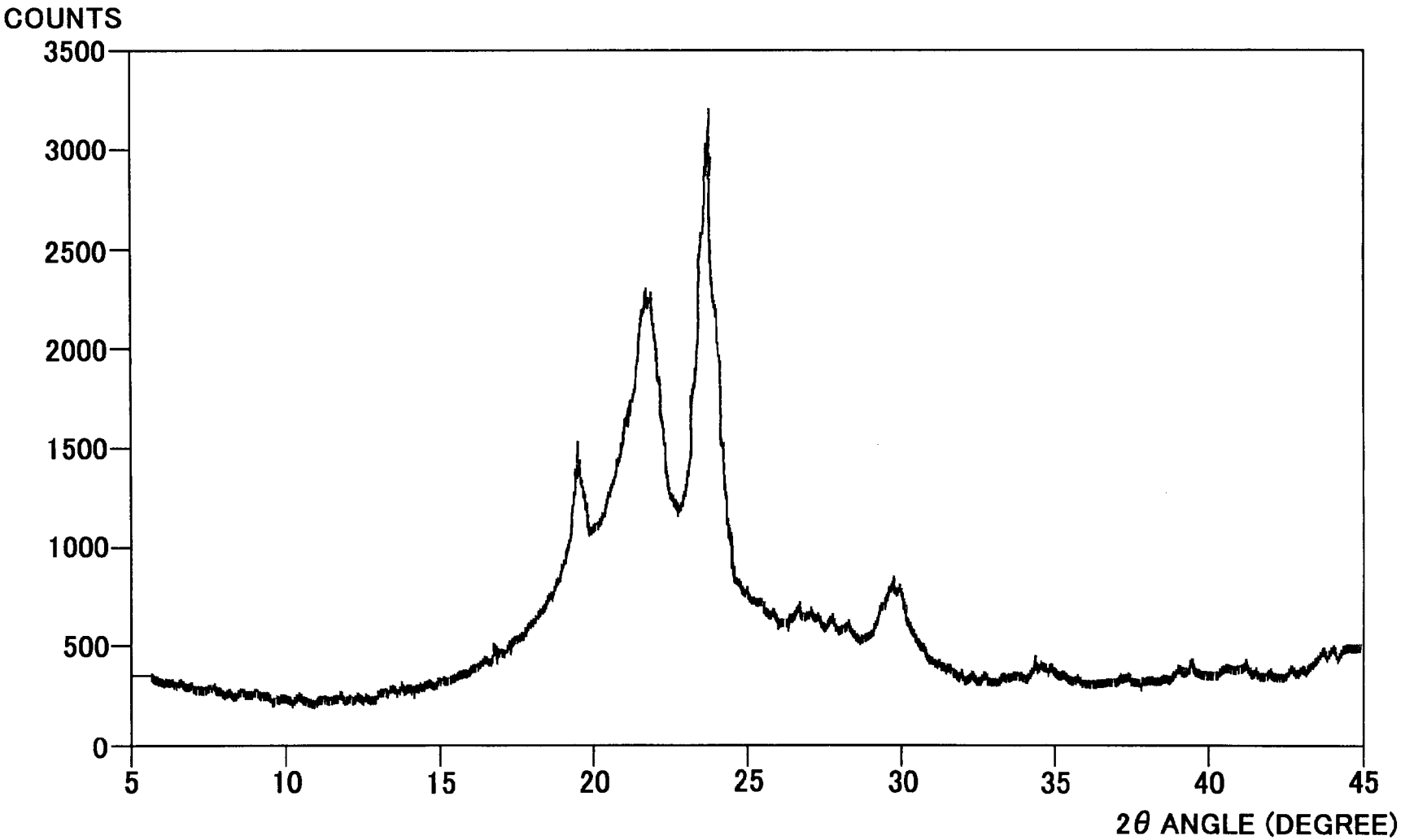
FIG. 3 is a schematic view illustrating the X-ray diffraction spectrum of the polyester resin A1 used in Example 1.
Figure 4:
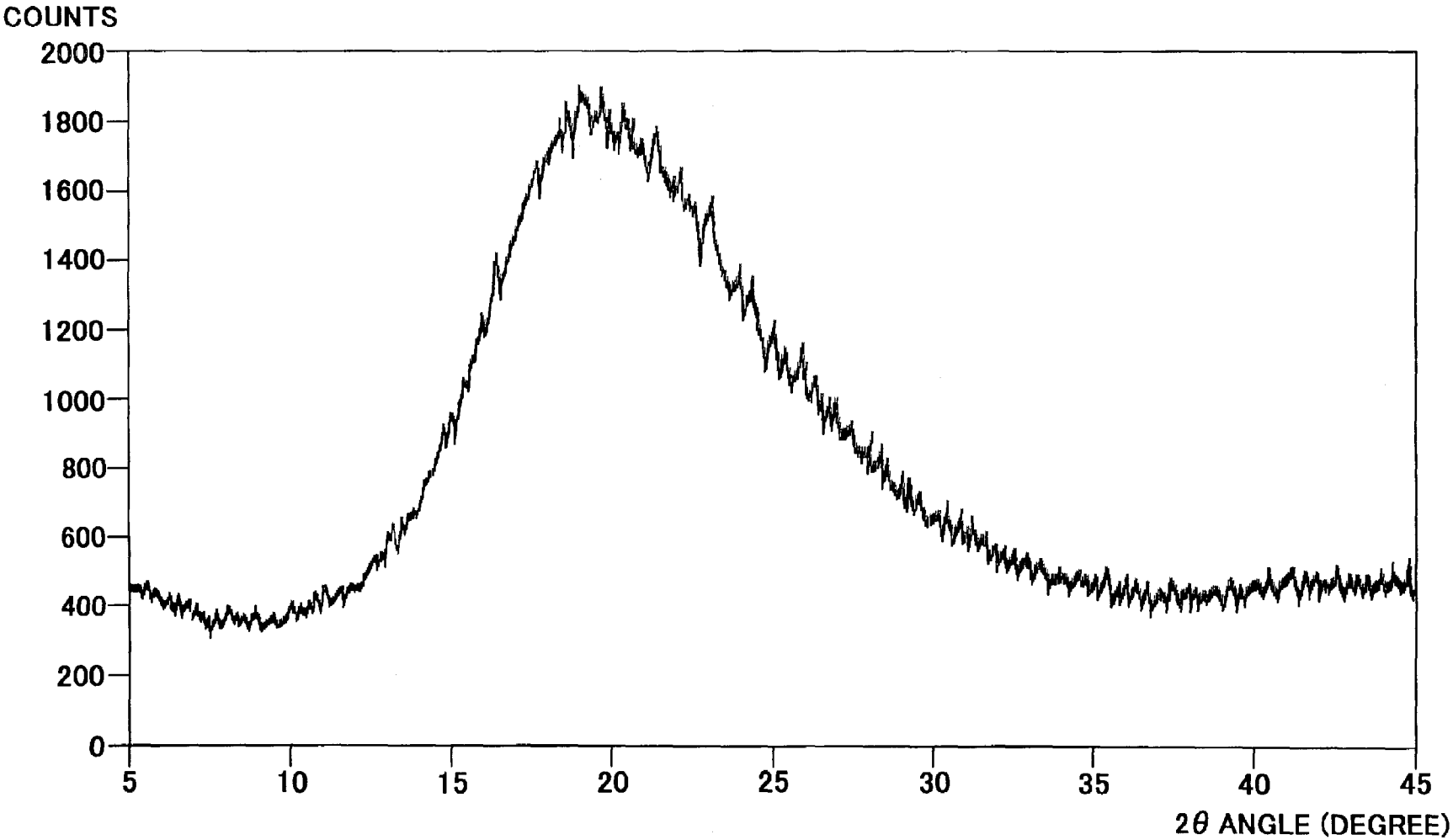
FIG. 4 is a schematic view illustrating the X-ray diffraction spectrum of the polyester resin A2 used in Comparative Example 1.
Figure 5:
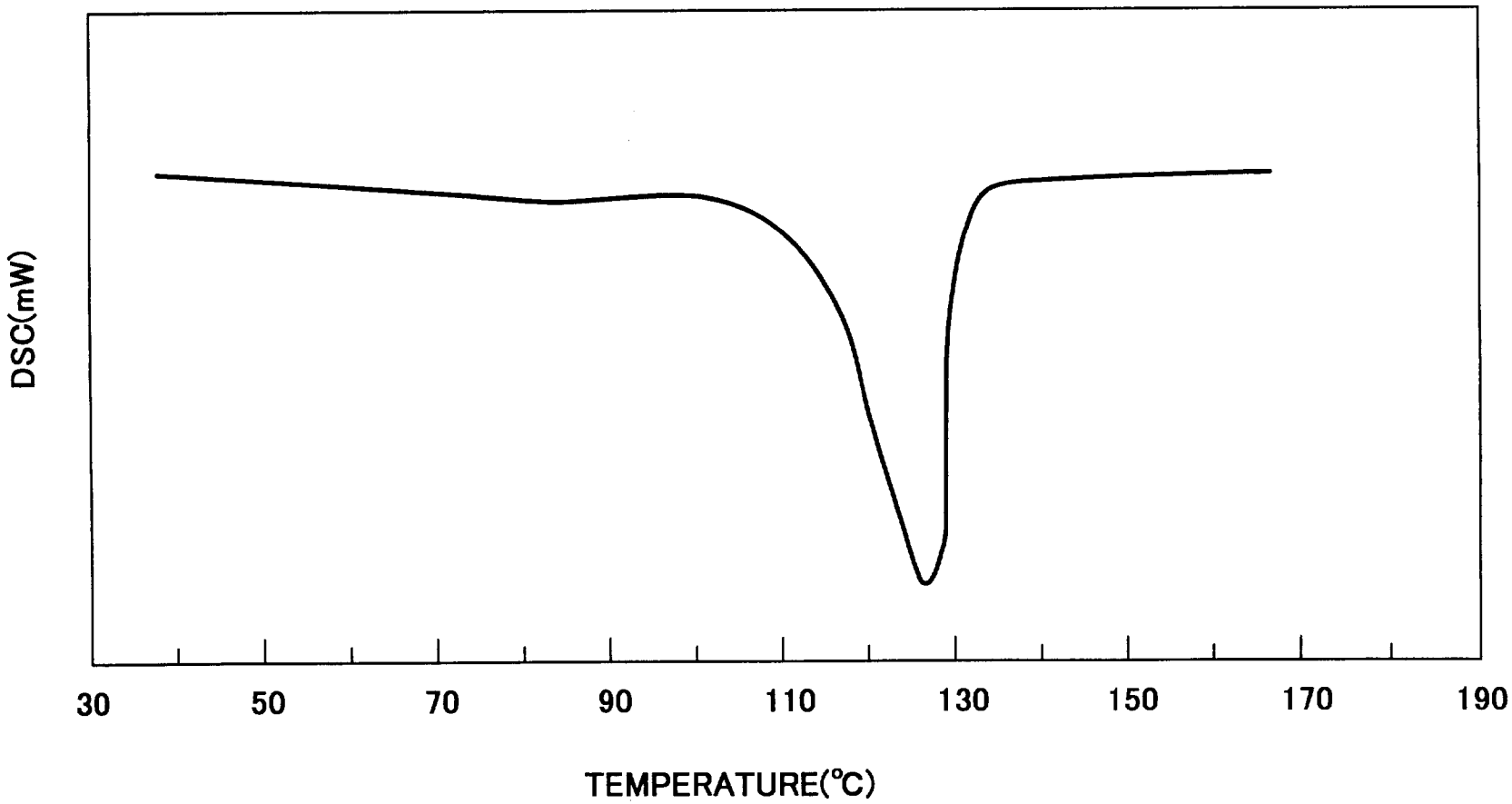
FIG. 5 is a schematic view illustrating the DSC curve of the polyester resin A1.
Figure 6:
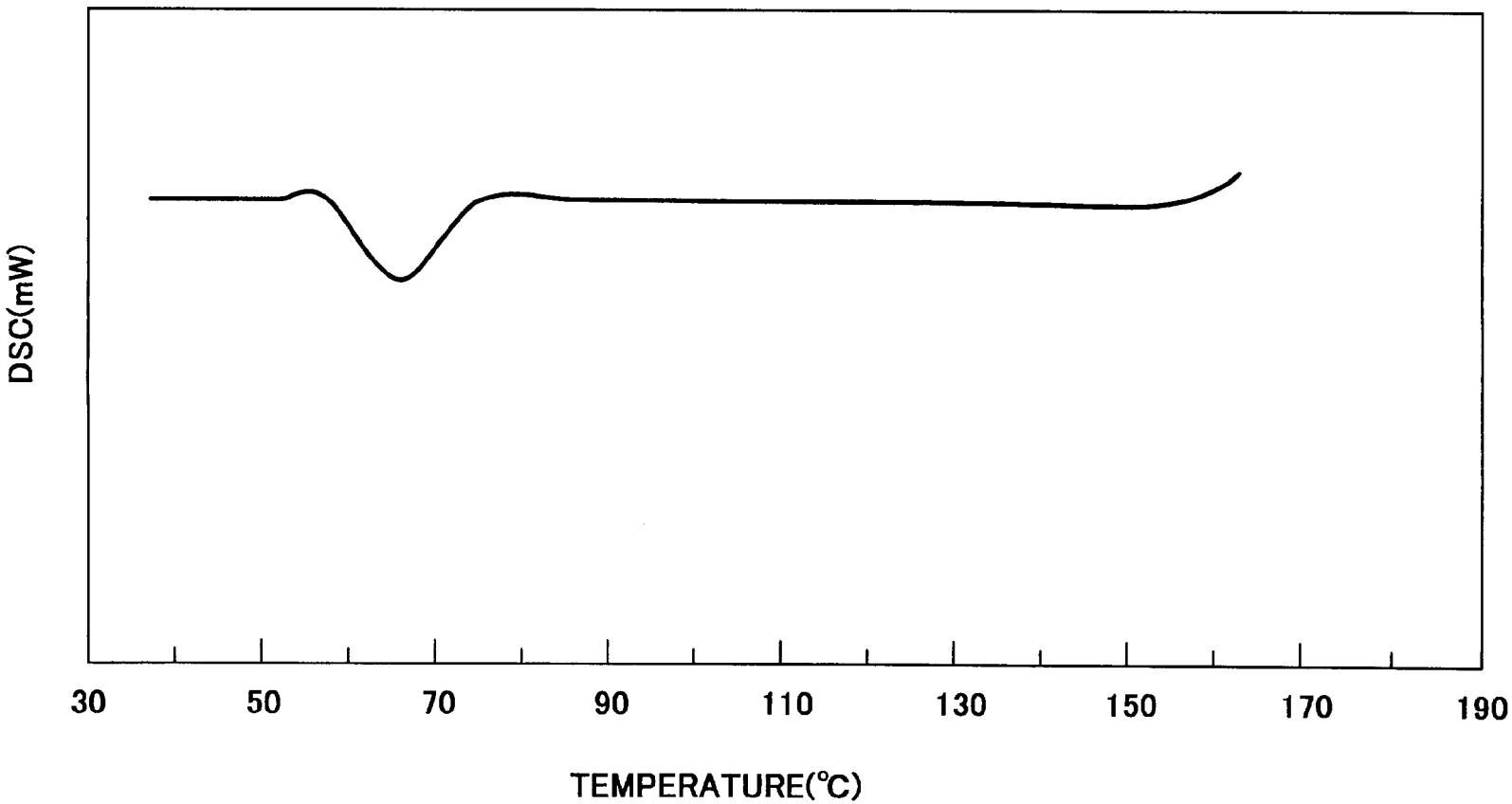
FIG. 6 is a schematic view illustrating the DSC curve of the polyester resin A2.

The X-ray diffraction patterns of a polyester resin A1 which is used in Example 1 described later and which has crystallinity and a polyester resin A2 which is used in Comparative Example 1 and which does not have crystallinity are shown in FIGS. 1 and 2, respectively. In addition, the DSC patterns of the polyester resins A1 and A2 are shown in FIGS. 3 and 4.

In order to impart good low temperature fixability to a toner, the polyester resin (A) is preferably included in the toner in an amount of from 1 to 50% by weight. When the content of the polyester resin (A) is too low, the low temperature fixability of the resultant toner deteriorates. In contrast, when the content is too high, the hot offset resistance of the toner deteriorates.

As mentioned above, it is preferable that at least two different kinds of resins (B) and (C) and a wax are included in the toner of the present invention as well as the polyester resin (A). In addition, it is preferable that the resins (B) and (C) have an island-sea structure such that the resin (C) is present like islands in a sea of the resin (B), and the wax is substantially included in the island of the resin (C). In order to securely form this island-sea structure, the resins (B) and (C) and the wax preferably have solubility parameters SP(B), SP(C) and SP(W) which satisfy the following relationships:

$$SP(B)>SP(C)>SP(W), \text{ and}$$

$$SP(B)-SP(C)\ 0.6.$$

In addition, it is preferable that the resin (A), resin (B), resin (C) and wax are included in the toner in an amount of from 1 to 50% by weight, from 55 to 96% by weight, from 2 to 44% by weight, and from 2 to 15% by weight, respectively, based on the total weight of the resins (A), (B) and (C) and the wax.

It is preferable that the resin (A) and the resin (B) also have a phase-separation structure such that the resin (A) is dispersed like islands in a sea of the resin (B) when the content of the resin (B) is greater than that of the resin (A). To the contrary, when the content of the resin (A) is greater than that of the resin (B), the resins (A) and (B) have a phase-separation structure such that the resin (B) is dispersed like islands in a sea of the resin (A). By forming such a phase-separation structure, the good properties of each of the resins can be effectively exhibited, and thereby the resultant toner has both a good low temperature fixability and a wide fixable temperature range.

Whether or not resins have a phase-separation structure in the toner can be determined by observing the cross section of the toner with a transmission electron microscope (TEM). Specifically, the pigment included in the toner is selectively dispersed in the resin (B), and therefore if a portion including no pigment is present like islands in a cross section of a toner, it can be said that the resins in the toner have a phase-separation structure. However, in order to prepare toner particles having uniform composition, the resin (A) is preferably dispersed finely in the toner particles such that the islands of the resin (A) cannot be observed by a TEM. Such a fine phase-separation structure is also included in the scope of the present invention.

The size of the resin (A) dispersed in the resin (B) can be changed by changing the conditions of kneading of the resins, such as temperature and kneading time, and formula of the toner constituents. For example, by increasing the shear strength when kneading the toner constituents, the resin (A) can be finely dispersed. In addition, by decreasing the content of the resin (A), the resin (A) can also be finely dispersed.

In conventional toners in which a wax is dispersed like islands in a sea of a resin, the shear stress is concentrated to the interfaces between the resin and the wax in the pulverization process, and thereby the toner is pulverized at the interfaces. Therefore, in the resultant pulverized toner, the wax is present on the surface of the toner particles at a concentration greater than the concentration of the wax in the entire toner. Therefore the resultant toner has poor transferability and durability.

In the toner of the present invention, the resin (C) is dispersed like islands in a sea of the resin (B), and the wax is mainly included in the islands of the resin (C). Therefore, the shear stress can be concentrated to the interfaces between the resin (B) and the resin (C). Accordingly, the concentration of the wax at the surface of the toner particles can be decreased, and thereby good transferability and durability can be imparted to the resultant toner. In addition, the wax is present in surface portions of the toner particles, and therefore the offset resistance can be maintained. In addition, since the area of the interfaces between the phase-separated resins, at which the shear stress is concentrated, increases, the toner constituent mixture can be easily pulverized, and thereby a small size toner can be efficiently produced.

In view of the color reproducibility, the gloss of the toner images is preferably not less than 5%, and more preferably not less than 10%. In order to produce toner images having such a gloss, it is preferable that the resin (B) includes substantially no tetrahydrofuran (THF)-insoluble component and has a weight average molecular weight not greater than 90,000 and more preferably not greater than 50,000. In addition, it is preferable that the resin (C) includes substantially no THF-insoluble component and has a weight average molecular weight not greater than 60,000. The weight average molecular weight of the resins (B) and (C) is preferably not less than 10,000 to impart good offset resistance to the resultant toner.

Suitable resins for use as the binder resins (A), (B) and (C) of the toner of the present invention include known resins. Specific examples of the resins include homopolymers and copolymers of one or more monomers such as styrene, p-chlorostyrene, vinyl toluene, vinyl chloride, vinyl acetate, vinyl propionate, methyl (meth)acrylate, ethyl (meth)acrylate, propyl (meth)acrylate, n-butyl (meth)acrylate, iso-butyl (meth)acrylate, dodecyl (meth)acrylate, 2-ethylhexyl (meth) acrylate, lauryl (meth)acrylate, 2-hydroxyethyl (meth)acrylate, hydroxypropyl (meth)acrylate, 2-chloroethyl (meth) acrylate, (meth)acrylonitrile, (meth)acrylamide, (meth) acrylic acid, vinyl methyl ether, vinyl ethyl ether, vinyl isobutyl ether, vinyl methyl ketone, N-vinyl pyrrolidone, N-vinyl pyridine, butadiene, etc. These resins can be used alone or in combination.

In addition, other resins such as polyester resins, polyol resins, polyurethane resins, polyamide resins, epoxy resins, rosins, modified rosins, terpene resins, phenolic resins, hydrogenated petroleum resins, etc. can be used alone or in combination.

Among the resins, polyester resins and polyol resins, which have been typically used for color toners, are preferably used as the resin (B). Suitable polyol resins include polyetherpolyol resins which have an epoxy skeleton and which are prepared by reacting (1) an epoxy resin; (2) an adduct of a dihydric phenolic compound with an alkylene oxide or a glycidyl ether compound of the adduct; and (3) a compound having an active hydrogen which can react with the epoxy group of the epoxy resin.

Styrene resins are preferably used as the resin (C) because of having good pulverizability and good charge stability under various environmental humidity conditions. Among the styrene resins, styrene-alkyl (meth)acrylate copolymers can be preferably used. In addition, waxes on which a vinyl resin is grafted can also be preferably used as a compatibility improving agent, which is used to finely disperse a wax in the resin (C). By using such a compatibility improving agent, the amount of the wax present on the surface of the toner particles can be further decreased, and thereby the transferability and durability of the toner can be further improved.

When resins (B1) and (B2) are used as the resin (B) at a eight ratio of (x):(1−x), the solubility parameter of the resin (B) is determined by the following equation:

$$SP(B)=SP(B1)\cdot x+SP(B2)\cdot(1-x)$$

Then the methods for measuring the properties of the resins (A), (B) and (C) will be explained in detail.

$F_{1/2}$ Temperature

In the present invention, the $F_{1/2}$ temperature of a resin is measured using a flow tester CFT-500 manufactured by Shimadzu Corp. The conditions of the flow tester are as follows:

(1) diameter of the die: 1 mm (2) pressure applied to the sample: 10 kg/cm$^2$ (3) temperature rising speed: 3° C./minute The $F_{1/2}$ temperature of a resin is defined as the mid-temperature of the flow starting temperature of the resin and the flow ending temperature of the resin when the resin is subjected to a heat analysis using the flow tester.

Glass Transition Temperature (Tg)

The glass transition temperature of a resin is measured with an instrument THERMOFLEX TG8110 manufactured by RIGAKU CORPORATION. The measurements are performed at a temperature rising speed of 10° C./minute.

Acid Value and Hydroxyl Value

The acid value and hydroxyl value are measured by a method based on JIS K0070. When a resin sample to be measured is not dissolved in the solvent specified in JIS K0070, a solvent such as dioxane, tetrahydrofuran or o-dichlorobenzene is used.

X-ray Diffraction Spectrum

An X-ray diffraction spectrum of a resin is obtained using an instrument RINT 1100 manufactured by RIGAKU CORPORATION.

The measuring conditions are as follows:

(1) Target: Cu (2) Voltage/current: 50 kV/30 mA (3) Goniometer: wide angle goniometer Endothermic Peak (DSC Pattern)

Measurements of the endothermic peak of a material are performed using an instrument, THERMOFLEX TG8110 manufactured by Rigaku Corporation. The temperature rising speed is 10° C./min. The measurements are repeatedly performed twice with respect to the same sample, and the second DSC pattern in the temperature rising process is evaluated to determine the endothermic peak of the sample.

Solubility Parameter (SP)

The solubility parameter δ of a resin is defined by the following equation based on the Hildebrand-Scatchard theory:

$$\delta=(\Delta Ev/V)^{1/2}$$

wherein ΔEv represents the vaporization energy of the resin and V represents the molecular volume. ΔEv/V represents a cohesion energy density.

The solubility parameter of a resin can be determined by various methods. In the present invention, the solubility parameter of a resin is calculated by the Fedor's method which uses the below-mentioned equation.

$$\text{Solubility parameter}=(\Sigma\Delta e_i/\Sigma\Delta v_i)^{1/2}$$

wherein $\Delta e_i$ represents the vaporization energy of one of the atoms or the atomic groups constituting the resin, and $\Delta v_i$ represents the molar volume of the atom or the atomic group.

Pulverizability

Each of toner constituent mixtures is pulverized under the same conditions. Then the average particle diameter of each of the pulverized mixtures is measured to compare the average particle diameter thereof. The smaller average particle diameter a pulverized mixture has, the better pulverizability the mixture has.

Content of Tetrahydrofuran-insoluble Components in Binder Resins

The content of tetrahydrofuran-insoluble components in the binder resins of a toner is determined by the following method.

At first, about 1.0 g of a toner is precisely weighed. The toner is mixed with 50 g of tetrahydrofuran, and the mixture is allowed to settle for 24 hours in a constant temperature chamber at 20° C. Then the liquid is subjected to filtering at room temperature using a filter paper 5C specified in JIS P3801. The filter paper with a residue thereon is dried, and the filter paper is weighed to determine the weight of the residue. The content of the tetrahydrofuran-insoluble components in the binder resins is determined by the following equation:

$$\text{Content (\%)}=(Wr-Wi)\times 100/(Wt-Wi)$$

wherein Wr represents the weight of the residue; Wi represents the weight of the tetrahydrofuran-insoluble components (such as colorants, charge controlling agents, fillers, etc.) in the toner sample other than the components in the binder resins, which weight is calculated referring to the formula of the toner; and Wt represents the weight of the toner sample.

If the content of the solid contents such as colorants, charge controlling agents and fillers is unknown, the content is preliminarily determined, for example, by a method such as thermal analyses.

Molecular Weight Measuring Method Using Tetrahydrofuran

In the present invention, the molecular weight of a resin is determined by a GPC (Gel Permeation Chromatography) method using tetrahydrofuran (THF) as a solvent. The measuring method is as follows.

At first, the column is stabilized in a heat chamber at 40° C. The solvent (i.e., THF) is flown through the column at a speed of 1 ml/minute. On the other hand, a resin to be measured is dissolved in THF to prepare a THF solution of the resin having a resin content of from 0.05 to 0.6% by weight. Then 50 to 200 μl of the THF solution of the resin is injected to the column to obtain a GPC spectrum.

The molecular weight of the resin is determined while comparing the molecular distribution curve thereof with the working curve which is previously prepared using several polystyrene standard samples each having a single molecular weight peak. Specific examples of the polystyrene standard samples include standard polystyrenes which are manufactured by Pressure Chemical Co. or Tosoh Corporation and each of which has a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

It is preferable to prepare a working curve using at least ten standard polystyrenes. A RI (refractive index) detector is used as the detector.

Molecular Weight Measuring Method Using O-dichlorobenzene

The procedure for the GPC method using o-dichlorobenzene is as follows.

At first, a column is stabilized in a chamber heated to 145° C. Then an eluent, i.e., o-dichlorobenzene including 2,6-di-t-butyl-p-cresol in an amount of 0.3%, is flown through the column at a speed of 1 ml/minute. Then 50 to 200 μl of a 0.3% o-dichlorobenzene solution of a resin to be measured which is heated to 140° C. is injected to the column. The measuring conditions are as follows:

(1) Measuring instrument: 150 CV from Waters (2) Column: AT-G+AT-806MS (two pieces) from Shodex (3) Slice width: 0.05 second Similarly to the above-mentioned method using THF, a working curve is previously prepared using standard polyestyrenes. Specific examples of the standard polystyrenes are mentioned above.

Suitable waxes for use as the wax (i.e., a release agent) in the toner of the present invention include known waxes. Specific examples of the waxes include synthetic hydrocarbon waxes such as low molecular weight polyethylene waxes, low molecular weight polypropylene waxes, low molecular weight polyolefin waxes, and Fisher-Tropsch waxes; natural waxes such as bees waxes, carnauba waxes, candelilla waxes, rice waxes, montan waxes; petroleum waxes such as paraffin waxes, and microcrystalline waxes; higher fatty acids and metal saots thereof such as stearic acid, palmitic acid and myristic acid; higher fatty acid amides; and synthetic ester waxes. In addition, modified waxes of these waxes can also be used.

Among these waxes, carnauba waxes, modified carnauba waxes and synthetic ester waxes are preferably used. This is because these waxes are properly dispersed finely in the polyester resins and polyol resins, and thereby good offset resistance, good transferability and good durability can be imparted to the resultant toner.

These waxes can be used alone or in combination. It is preferable to use waxes having a melting point of from 70 to 125° C. in the present invention. When the melting point of the wax added in the toner is not lower than 70° C., good transferability and good durability can be imparted to the resultant toner. When the melting point of the wax added in the toner is not higher than 125° C., the wax in the resultant toner is rapidly melted when heated during the fixing process, and thereby the toner can exhibit good releasability.

The content of the waxes (i.e., the release agent) in the toner is preferably 2 to 15% by weight based on the total weight of the toner. When the content is too low, the resultant toner has poor offset resistance. When the content is too high, the transferability and durability of the toner deteriorate.

It is very important for the wax in the toner to have a property so as to be insoluble in the resin (C). In addition, the maximum long axis particle diameter of the wax dispersed in the toner is preferably not greater than ½, and preferably ⅓, of the maximum particle diameter of the toner. When the maximum long axis particle diameter of the dispersed wax is less than 0.5 μm, the wax tends not to exude from the toner during the fixing process, and thereby the offset resistance of the toner is not satisfactory. Therefore, the maximum long axis particle diameter of the dispersed wax is preferably not less than 0.5 μm.

The maximum long axis particle diameter of the dispersed wax is measured by the following method.

A toner sample is mixed with a solvent which can dissolve the resins in the toner but does not dissolve the wax in the toner, to dissolve the resins and to prepare a dispersion. The dispersion was observed with a microscope of 1,000 power magnification to determine the maximum long axis particle diameter of the dispersed wax.

In addition, the maximum particle diameter of the toner is determined by the following method. The particle diameter distribution of the toner is determined using a particle analyzer, COULTER COUNTER, manufactured by Coulter Electronics, Inc. The average particle diameter of the channel in which the maximum particle is included is defined as the maximum particle diameter of the toner.

The solubility parameter of a wax is determined by a method in which the wax is dissolved in various solvents having a known solubility parameter. The solubility parameter of the wax is closer to that of the solvent which can easily dissolve the wax.

The colorants for use in the toner of the present invention include known color pigments and dyes which can be used for yellow, magenta, cyan and black color toners.

Specific examples of the yellow colorants include cadmium yellow, Mineral Fast Yellow, Nickel Titan Yellow, Naples yellow, Naphthol Yellow S, Hansa Yellow G, Hansa Yellow 10G, Benzidine Yellow GR, Quinoline Yellow Lake, Permanent Yellow NCG, Tartrazine Yellow Lake, etc.

Specific examples of the orange colorants include Molybdenum Orange, Permanent Orange GTR, Pyrazolone Orange, Vulcan Orange, Indanthrene Brilliant Orange RK, Benzidine Orange G, Indanthrene Brilliant Orange GK, etc.

Specific examples of the red colorants include red iron oxide, cadmium red, Permanent Red 4R, Rithol Red, Pyrazolone Red, Watchung Red calcium salts, Lake Red D, Brilliant Carmine 6B, Eosine Lake, Rhodamine Lake B, alizarine lake, Brilliant Carmine 3B, etc.

Specific examples of the violet colorants include cobalt blue, Alkali Blue, Victoria Blue Lake, Phthalocyanine Blue, metal-free Phthalocyanine Blue, partially chlorinated Phthalocyanine Blue, Fast Sky Blue, Indanthrene Blue BC, etc.

Specific examples of the green colorants include chrome green, chromium oxide, Pigment Green B, Malachite Green Lake, etc.

Specific examples of the black colorants include carbon black, oil furnace black, channel black, lamp black, acetylene black, azine dyes such as Aniline Black, metal salts of azo dyes, metal oxides, complex metal oxides, etc.

These dyes and pigments can be used alone or in combination.

The toner of the present invention may include a charge controlling agent, if desired. Specific examples of the charge controlling agent include Nigrosine; azine dyes including an alkyl group having 2 to 16 carbon atoms (disclosed in Published Examined Japanese Patent Application (hereinafter referred to as JP-B) No. 42-1627); basic dyes (e.g., C.I. Basic Yellow 2 (C.I. 41000), C.I. Basic Yellow3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42045), and C.I. Basic Green 4 (C.I. 42000)), and lakes of these basic dyes; C.I. Solvent Black 8 (C.I. 26150); quaternary ammonium chlorides such as benzoylmethylhexadecylammonium chloride and decyltrimethylammonium chloride; dialkyl tin compounds such as dibutyl tin and dioctyl tin; dialkyl tin borate compounds; guanidine derivatives; vinyl polymers having an amino group; polyamine resins such as condensation polymers having an amino group; metal complexes of monoazo dyes (disclosed in JP-B Nos. 41-20153, 43-27596, 44-6397 and 45-26478); metal (e.g., Zn, Al, Co, Cr, and Fe) complexes of salicylic acid, dialkyl salicylate, naphthoic acid and dicarboxylic acids (disclosed in JP-B Nos. 55-42752 and 59-7385); sulfonated copper phthalocyanine; organic boron salts; fluorine-containing quaternary ammonium salts; calixarene compounds, etc. Charge controlling agents having white color, such as metal salts of salicylic acid derivatives, are preferably used for the color toners other than black toners.

The toner of the present invention preferably includes an external additive such as inorganic particulate materials (e.g., silica, titanium oxide, alumina, silicon carbide, silicon nitride, boron nitride, etc.) and particulate resins. The external additive is added to mother toner particles to improve the transferability and durability of the resultant toner. The external additive covers the wax present on the surface of the mother toner particles, which wax deteriorates transferability and durability of the toner. In addition, the external additive covers the surface of the mother toner particles, and thereby the area of the surface of the toner contacting other materials such as carriers and image bearing members can be decreased, resulting in improvement of the transferability and durability of the resultant toner. The inorganic particulate materials used as an external additive are preferably hydrophobized. In particular, hydrophobized metal oxides such as silica and titanium oxide are preferably used. Suitable particulate resins for use as the external additive include polymethyl methacrylate and polystyrene which are prepared by a soap-free emulsion polymerization method and which have an average particle diameter of from about 0.05 μm to about 1 μm.

A combination of a hydrophobized silica and a hydrophobized titanium oxide is preferably used as the external additive. In this case, it is preferable that the content of the hydrophobized titanium oxide is greater than that of the hydrophobized silica in the toner because the resultant toner can maintain good charge stability under various environmental humidity conditions.

In addition, it is preferable to use a relatively large silica having a specific surface area of from 20 to 50 $m^2/g$ or a relatively large particulate resin having an average particle diameter of from one hundredth (1/100) to one eighth (1/8) of the average particle diameter of the toner in combination with the particulate inorganic material mentioned above, to improve the durability of the resultant toner. The reason is as follows:

When a relatively small metal oxide is used as an external additive for a toner, the metal oxide tends to be embedded in the mother toner particles when the toner is mixed with a carrier and agitated to be used for development. When such a relatively large external additive is used in combination with such a relatively small metal oxide, the metal oxide is prevented from being embedded in the mother toner particles.

The above-mentioned inorganic particulate materials and organic particulate materials can also be included in the toner as an internal additive. In this case, although the degree of the improvement of the transferability and durability is smaller than in the case in which the material is used as an external additive, the pulverizability of the mixture of toner constituents can be improved.

The toner in which one or more of the inorganic particulate materials and organic particulate resins are included as an internal additive can also include one or more of the inorganic particulate materials and particulate resins an external additive. In this case, the external additive is prevented from being embedded into the toner particles, and thereby the resultant toner has a combination of good transferability and good durability.

Specific examples of the hydrophobizing agents useful for hydrophobizing inorganic particulate materials include dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, hexatolyldisilazane, etc.

In addition, titanate coupling agents and aluminum coupling agents can also be used as a hydrophobizing agent.

As an external additive, lubricants such as fatty acid metal salts, polyvinylidenefluoride powders, etc. can be used in combination with the inorganic particulate materials and particulate resins to improve the cleaning property of the resultant toner.

The color toner of the present invention can be used as a one component developer and for two component developers.

When the toner is used for two component developers, the toner is mixed with a carrier. Suitable materials for use as the carrier include known carrier materials. Specific examples of such carrier materials include iron powders, ferrite powders, magnetite powders, nickel powders, glass beads, etc. These carrier materials may be coated with a resin, etc. The volume average particle diameter thereof is preferably from 25 to 200 μm.

The toner of the present invention can be manufactured by any one of known manufacturing methods.

At first toner constituents are kneaded upon application of heat thereto.

Suitable kneading machines useful for kneading toner constituents include batch-processing keaders such as two-roll kneaders and Bambury's mixers; continuous two-axis kneaders such as KTK type two-axis extruders (manufactured by Kobe Steel, Ltd.), TEM type two-axis extruders and KCK type two-axis extruders (manufactured by Toshiba Machine Co., Ltd.), PCM type two-axis extruders (manufactured by Ikegai Corporation), KEX type two-axis extruders (manufactured by Kurimoto, Ltd.); continuous single-axis extruders such as KO-KNEADER (manufactured by Buss AG); and the like kneaders.

The thus kneaded toner constituents (hereinafter the mixture) are cooled and then pulverized to prepare a mother toner. When pulverizing, the kneaded mixture is typically crushed by a hammer mill or ROTOPLEX and then pulverized by an air pulverizer or a mechanical pulverizer. The pulverization is preferably performed such that the average particle diameter of the pulverized mixture is from 3 to 20 μm. Then the pulverized mixture is air-classified to prepare a mother toner such that the particle diameters of the mother toner particles fall in a range of from 5 to 15 μm.

Then the mother toner is mixed with an external additive using a mixer while being agitated. In this process, the external additive covers the surface of the mother toner particles while the particles of the external additive are dissociated from each other. It is important to uniformly and strongly adhere the external additive, such as inorganic particulate materials and particulate resins, on the surface of the mother toner particles to produce a toner having good durability.

In each of the cases in which the toner of the present invention is used as a one-component developer or for a two-component developer, the toner is contained in a container. The toner container is typically delivered separately from the image forming apparatus so that the users can set the toner container in the image forming apparatus.

As the toner container, any known toner containers such as bottle type containers and cartridge type containers can be used.

In addition, the toner of the present invention can be used for any known image forming apparatus in which images are formed by electrophotography, such as copiers and printers.

Then the image forming method and apparatus of the present invention will be explained referring to FIGS. 1 and 2.

FIG. 1 is a schematic view for explaining the way to form toner images using the image forming method and apparatus of the present invention.

In FIG. 1, a copier 201 is mainly constituted of a scanner 101 serving as an image reading device and a printer 112 serving as an image outputting device. The scanner 101 optical reads the image of an original, and includes a contact glass 209 serving as an original setting table, a light irradiating lamp 210, a reflection mirror 211, a focusing lens 212, a CCD image sensor and other devices. Halogen lamps are typically used as the light irradiating lamp 210. The way to read the original image is as follows.

The light irradiating lamp 210 irradiates the original set on the contact glass 209 with light. The light reflected by the original is guided to the focusing lens 212 by the reflection mirror 211. The reflection light is focussed on the CCD image sensor 213. The CCD image sensor 213 coverts the reflection light into digital signals corresponding to the original image. The CCD image sensor 213 is a full color image sensor, and separates the light signals into, for example, R (red) color signals, G (green) color signals and B (blue) color signals. Thus, the CCD image sensor 213 outputs digital electric signals correspondint to the R, G and B color images. In the CCD image sensor 213, CCDs (charge coupled devices) are arranged in a line in the vertical direction (hereinafter referred to as a main scanning direction) in FIG. 1.

The electric signals output by the CCD image sensor 213 are subjected to image processing treatments such as color conversion treatment by an image processing section mentioned later, resulting in formation of C (cyan) image data, M (magenta) image data, Y (yellow) image data and BK (black) image data. In the printer 112, C, M, Y and BK images are formed according to the C, M, Y and BK color image data using C, M, Y and BK toners, resulting in formation of a full color image.

A photoreceptor 215 serving as an image bearing member is arranged in a center of the printer 112. The photoreceptor 215 is an organic photosensitive drum (OPC) and has a diameter of about 120 mm. Around the photoreceptor 215, a charger 207, a BK developing unit 202, a C developing unit 203, a M developing unit 204, a Y developing unit 205, an intermediate transfer belt 206, a cleaning device 214 and other devices are provided. The developing units 202, 203, 204 and 205 include developers DK, DC, DM and DY, respectively, each of which includes the toner of the present invention. A laser optical device 208 is arranged at a location above the photoreceptor 215 and below the scanner 101. The laser optical device 208 emits a laser beam according to the color image data to scan the surface of the photoreceptor 215, which has been uniformly charged, with the laser beam, resulting in formation of an electrostatic latent image. The laser optical device 208 are mainly constituted of a laser diode, and a polygon mirror which deflects the laser beam.

Then the image forming processes performed in the printer 112 will be explained referring to formation of a BK image.

An electrostatic latent image, which has been formed on the photoreceptor 215 according to a BK image data by the laser optical device 208, is developed by the BK developing unit 202 including the developer DK, resulting in formation of a BK toner image on the photoreceptor 215. The BK toner image is then transferred onto the intermediate transfer belt 206 (this transferring process is hereinafter referred to as a belt-transfer process) by a transfer roller 221. The above-mentioned sequential operations of electrostatic latent image formation, development, and belt-transfer are repeatedly performed so that C, M, Y and BK color toner images are overlaid on the intermediate transfer belt 206.

The color toner images thus formed on the intermediate transfer belt 206 are transferred on a receiving material P such as receiving papers, which has been fed by a paper feeding unit 216, using a transfer bias roller 217. The receiving material P bearing the color toner images thereon is then fed to a fixing device 219 by a feeding belt 218.

The fixing device 219 melts the color toner images by applying heat and pressure thereto to fix the color toner images on the receiving material P. The receiving material P on which the color toner images have been fixed is discharged on a discharge tray 220. Thus, a hard copy is formed.

On the other hand, the toner particles remaining on the surface of the photoreceptor 215 after the belt-transfer process are collected by the cleaning device 214 to clean the photoreceptor 215. The charges remaining on the photoreceptor 215 are then discharged by a discharger. In addition, the toner particles remaining on the surface of the intermediate transfer belt 206 are collected by a belt cleaning device 222 to clean the intermediate transfer belt 206.

This image forming device can be fixedly set in an image forming apparatus, or detachably attached to an image forming apparatus as a process cartridge. The process cartridge of the present invention is a unit including a container containing the toner of the present invention and at least one of a developing device configured to develop an electrostatic latent image formed on an image bearing member with a developer including the toner of the present invention to form a toner image on the image bearing member, a charger configured to charge the image bearing member, and a cleaner configured to clean the surface of the image bearing member.

FIG. 2 is a schematic view illustrating an embodiment of the tandem type image forming apparatus of the present invention. However, the tandem type image forming apparatus of the present invention is not limited thereto.

In FIG. 2, the tandem type image forming apparatus has a cyan image forming unit 76C, a magenta image forming unit 76M, a yellow image forming unit 76Y and a black image forming unit 76K. Drum photoreceptors 71C, 71M, 71Y and 71K rotate in a direction indicated by a respective arrow. Around the photoreceptors 71C, 71M, 71Y and 71K, chargers 72C, 72M, 72Y and 72K, image developers 74C, 74M, 74Y and 74K, and cleaners 75C, 75M, 75Y and 75K are arranged in this order in the clockwise direction. As the chargers, known chargers such as corona chargers and charging rollers can be used. Imagewise light irradiators 73C, 73M, 73Y and 73K irradiate with laser light a surface point of the respective photoreceptors located between the chargers and the image developers to form an electrostatic latent image on the respective photoreceptor.

The four image forming units 76C, 76M, 76Y and 76K are arranged along an intermediate transfer belt 80.

Characters Dk, Dy, Dm and Dc represent a black developer, a yellow developer, a magenta developer, and a cyan developer, respectively. Each developer includes a color toner of the present invention and a carrier. The electrostatic latent images formed on the photoreceptors 71K, 71Y, 71M and 71C are developed with the developers Dk, Dy, Dm and Dc, respectively, resulting in formation of color toner images on the respective photoreceptors 71K, 71Y, 71M and 71C.

The intermediate transfer belt 80 contacts the respective photoreceptor 71C, 71M, 71Y or 71K at an image transfer point located between the respective image developer and the respective cleaner to receive color toner images formed on the photoreceptors. At the backside of each image transfer point of the intermediate transfer belt 80, transfer brushes 81C, 81M, 81Y and 81K are arranged to apply a transfer bias to the intermediate transfer belt 80. The color toner images are transferred onto a receiving material 77 which is timely fed to the image transfer points by a feeding roller 78 and a pair of registration rollers 79. The color toner images (i.e., a full color image) on the receiving material 77 are fixed by a fixer 82. Thus, a full color hard copy is produced.

The above-mentioned tandem type image forming apparatus can transfer plural color images at the same time, and therefore full color images can be produced at a high speed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed with a blender.

| | |
|---|---|
| Polyester resin (A1) | 10 |
| Polyester resin (B1) | 70 |

(content of THF-insoluble components: 0%, weight average molecular weight: 17,000, glass transition temperature: 59° C., solubility parameter: 10.8)

| | |
|---|---|
| Styrene-methyl acrylate (C1) | 15 |

(content of THF-insoluble components: 0%, weight average molecular weight: 15,000, glass transition temperature: 62° C., solubility parameter: 9.3, pulverizability: better than those of polyester resin B1 and the below-mentioned polyethylene wax)

| | |
|---|---|
| Polyethylene wax | 5 |

(melting point: 99° C., penetration: 1.5 mm, solubility parameter: 8.1)

| | |
|---|---|
| Charge controlling agent | 2 |

(a metal salt of a salicylic acid derivative)

| | |
|---|---|
| Colorant (Copper phthalocyanine blue pigment) | 2.5 |

The resins A1, B1 and C1 are examples of the resins A, B and C in the present invention.

The mixture was fully kneaded with a two-axis extruder and then cooled. Then the kneaded mixture was pulverized and classified. Thus, a cyan mother toner having a volume average particle diameter of about 7.5 μm was prepared.

Then 100 parts of the thus prepared mother toner were mixed with 0.4 parts of a hydrophobized silica serving as an external additive, which had been subjected to a surface treatment using hexamethyl disilazane and which has an average primary particle diameter of 0.02 μm, using a Henshel mixer. Thus, a cyan toner was prepared.

The maximum particle diameter of the toner was 18 μm, and the maximum long axis particle diameter of the wax dispersed in the toner was 7 μm. When the cross section of the toner was observed with a transmission electron microscope, it was confirmed that the resin (C1) is dispersed like islands in the resin (B1) and the wax is included in the resin (C1).

Next, 5 parts of the toner were mixed with 95 parts of a carrier which had been coated with a silicone resin to prepare a two-component developer.

The toner and developer were evaluated with respect to the following items.

1. Gloss of Images

The developer was set in a color copier, PRETER 650 manufactured by Ricoh Co., Ltd. in which a roller covered with a PFA tube is used as the fixing roller and the silicone oil coating device is removed therefrom, and solid toner images were produced such that the toner images have a weight of 1.0±0.1 mg/cm$^2$. The temperature of the surface of the fixing roller was set to be 160° C. The gloss of the solid toner images was measured with a gloss meter manufactured by Nippon Denshoku Kogyo K.K. The gloss was measured by irradiating the toner images with light whose angle of the incidence was 60°.

A full color PPC paper type 6000<70 W manufactured by Ricoh Co., Ltd. was used as the receiving paper. The higher the gloss, the glossier the toner images. In order to produce full images having good color reproducibility, each of the color images needs to have a gloss not less than about 10%.

The fixing roller was prepared by covering a roller having a silicone rubber of 2 mm thick thereon with a PFA tube having a thickness of 25 μm. The fixing conditions are as follows:

(1) Fixing pressure: 80 Kg
(2) Nip width: 8 mm
(3) Shape of nip portion: the fixing roller is recessed like U-form at the nip portion.
(4) Power of heater of fixing roller: 650 W
(5) Power of heater of pressure roller: 400 W 2. Offset Resistance Toner images were produced using the copier mentioned above for use in the evaluation of gloss while the temperature of the fixing roller was changed at an interval of 5° C. The produced toner images were observed to determine whether or not an offset problem occurs.

When the toner images were produced, no oil was applied to the fixing roller. In addition, the full color PPC paper type 6000<70 W manufactured by Ricoh Co., Ltd. was used as the receiving material.

The offset resistance of the toners was graded as follows:

◎: the toner has excellent offset resistance because of not causing the offset problem until the fixing roller is heated to a very high temperature.

○: the toner has good offset resistance because of not causing the offset problem until the fixing roller is heated to a high temperature.

Δ: the toner has unsatisfactory offset resistance, but when a small amount (0.5 to 1 mg/A-4 size copy) of silicone oil is applied to the fixing roller, the toner has good offset resistance.

X: the toner has poor offset resistance such that the offset problem is caused even when the fixing temperature is low, and even when a small amount of silicone oil is applied to the fixing roller, the offset problem cannot be avoided.

3. Low Temperature Fixability

Similarly to the image forming method as performed in the evaluation of the gloss, toner images were produced while the fixing temperature was changed.

A toner image having an image density of 1.2 was rubbed ten times with a sand-containing rubber eraser of a clock meter to determine the fixing rate of the toner image. The fixing rate is determined as follows:

$$\text{Fixing rate (\%)}=\{IDa/IDb\}\times 100$$

Wherein IDa and IDb represent the image densities of the toner image after and before the rubbing.

The lowest fixing temperature is determined as a fixing temperature at which the fixed toner image has a fixing rate not less than 70%.

The low temperature fixability of the toner was graded as follows:

◎: the toner has excellent low temperature fixability because of having a low lowest fixing temperature.

○: the toner has good low temperature fixability.

Δ: the toner has the same level of low temperature fixability as those of conventional toners.

X: the toner has poor low temperature fixability because the lowest fixing temperature thereof is higher than those of conventional toners.

4. Transferability

Similarly to the image forming method as performed in the evaluation of the gloss, image forming operations were performed but the image forming operations were stopped at a time when a toner image was being transferred onto a receiving paper to observe the amount of the toner remaining on the intermediate transfer belt. The transferability of the toner was graded as follows:

◎: the toner has excellent transferability because the amount of the toner remaining on the intermediate transfer belt is very small.

○: the toner has good transferability because the amount of the toner remaining on the intermediate transfer belt is small.

Δ: the toner has the same level of transferability as those of conventional toners including a wax.

X: the toner has poor transferability because the amount of the toner remaining on the intermediate transfer belt is very large.

5. Durability

Similarly to the image forming method as performed in the evaluation of the gloss, 50,000 copies of an original having an image area of 10% were continuously produced to determine whether or not the charging quantity of the toner decreased. The durability of the toner was graded as follows:

◎: the toner has excellent durability because decrease in charge quantity of the toner during the running test is very small.

○: the toner has good durability because decrease in charge quantity of the toner during the running test is small.

Δ: the toner has the same level of durability as those of conventional toners including a wax.

X: the toner has poor durability because decrease in charge quantity of the toner during the running test is very large.

6. Charge Stability Under Low and High Humidity Conditions

The two component developer was prepared under two environmental conditions of 10° C./15% RH and 30° C./90% RH. The charge quantities (i.e., L (μc/g) and H (μc/g)) of the thus prepared two component developers were measured by a blow-off method to determine the environmental variation of the charge quantity of the toner. The environmental variation of the charge quantity is obtained by the following equation, and is preferably not greater than 40% and more preferably not greater than 20%.

$$\text{Environmental variation (\%)}=\{2(L-H)/(L+H)\}\times 100$$

The charge stability of the toner was graded as follows:

◎: the environmental variation is less than 20%.

○: the environmental variation is not less than 20% and less than 40%.

Δ: the environmental variation is not less than 40% and less than 70%.

X: the environmental variation is not less than 70%.

7. Observation of Toner Structure

Toner particles were embedded in an epoxy resin and an ultrathin section of the toner particles was prepared. The ultrathin section was dyed with RuO4 to be observed with a transmission electron microscope.

Comparative Example 1

The procedure for preparation and evaluation of the toner and developer in Example 1 was repeated except that the polyester resin (A1) was replaced with a polyester resin (A2) whose properties and composition are described in Table 1.

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1).

Example 2

The procedure for preparation and evaluation of the toner and developer in Example 1 was repeated except that the polyester resin (A1) was replaced with a polyester resin (A3) whose properties and composition are described in Table 1 (i.e., which is an example of the resin A in the present invention)

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1).

Example 3

The procedure for preparation and evaluation of the toner and developer in Example 1 was repeated except that the polyester resin (A1) was replaced with a polyester resin (A4) whose properties and composition are described in Table 1 (i.e., which is an example of the resin A in the present invention)

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1)

Example 4

The procedure for preparation and evaluation of the toner and developer in Example 1 was repeated except that the polyester resin (A1) was replaced with a polyester resin (A5) whose properties and composition are described in Table 1 (i.e., which is an example of the resin A in the present invention).

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1).

Example 5

The procedure for preparation and evaluation of the toner and developer in Example 1 was repeated except that the formula of the mother toner was replaced with the following.

| | |
|---|---|
| Polyester resin (A1) | 25 |
| Polyester resin (B1) | 55 |
| Styrene-methyl acrylate (C1) | 15 |
| Polyethylene wax (melting point: 99° C., penetration: 1.5 mm, solubility parameter: 8.1) | 5 |
| Charge controlling agent (a metal salt of a salicylic acid derivative) | 2 |
| Colorant (Copper phthalocyanine blue pigment) | 2.5 |

The maximum particle diameter of the resultant toner was 16 μm and the maximum long axis particle diameter of the wax included in the toner was 9 μm. In addition, when the cross section of the toner was observed with a transmission electron microscope, it was confirmed that the resin (C1) is dispersed like islands in the resin (B1), and the wax is included in the resin (C1).

Example 6

The procedure for preparation and evaluation of the toner and developer in Example 1 was repeated except that the formula of the mother toner was replaced with the following.

| | |
|---|---|
| Polyester resin (A1) | 0.5 |
| Polyester resin (B1) | 79.5 |
| Styrene-methyl acrylate (C1) | 15 |
| Polyethylene wax (melting point: 99° C., penetration: 1.5 mm, solubility parameter: 8.1) | 5 |
| Charge controlling agent (a metal salt of a salicylic acid derivative) | 2 |
| Colorant (Copper phthalocyanine blue pigment) | 2.5 |

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1).

Example 7

The procedure for preparation and evaluation of the toner and developer in Example 1 was repeated except that the polyester resin (A1) was replaced with a polyester resin (A6) whose properties and composition are described in Table 1 (i.e., which is an example of the resin A in the present invention)

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1).

Example 8

The procedure for preparation and evaluation of the toner and developer in Example 1 was repeated except that the polyester resin (A1) was replaced with a polyester resin (A7) whose properties and composition are described in Table 1 (i.e., which is an example of the resin A in the present invention).

The maximum particle diameter of the resultant toner was 18 μm and the maximum long axis particle diameter of the wax included in the toner was 7 μm. In addition, when the cross section of the toner was observed with a transmission electron microscope, it was confirmed that the resin (C1) is dispersed like islands in the resin (B1), and the wax is included in the resin (C1).

The properties and compositions of the polyester resins (A1) to (A7) are as follows.

TABLE 1

| Polyester resin A | Crystallinity | Presence or absence of the group of formula (1) | $F_{1/2}$ (° C.) | Tg (° C.) | Mn | Mw | Mw/Mn |
|---|---|---|---|---|---|---|---|
| A1 | Yes* | Yes** | 128 | 126 | 1420 | 6200 | 4.4 |
| A2 | No | No | 106 | 61 | 2010 | 6610 | 3.3 |
| A3 | Yes* | Yes** | 141 | 140 | 1860 | 9490 | 5.1 |
| A4 | Yes* | Yes** | 68 | 68 | 1080 | 2052 | 1.9 |
| A5 | Yes* | Yes** | 112 | 116 | 1680 | 8900 | 5.3 |
| A6 | Yes* | Yes** | 128 | 126 | 1390 | 6290 | 4.5 |
| A7 | Yes* | Yes** | 119 | 120 | 1290 | 6100 | 4.7 |

* Peaks are observed at Bragg (2 θ) angles of from 19° to 20°, from 21° to 22°, from 23° to 25° and from 29° to 31° in their X-ray diffraction spectrum. In addition, an endothermic peak is observed in their DSC pattern such that the top peak is present in a temperature range of from 80 to 130° C.
** it is confirmed by analysis of solid C13 NMR that the polyester resin includes a group having formula (1).

| Polyester resin A | Acid value (mgKOH/g) | Hydroxyl value (mgKOH/g) | Acid unit | Alcoholic unit |
|---|---|---|---|---|
| A1 | 31.1 | 29.6 | Maleic acid and succininc acid | 1,4-butanediol and 1,6-hexanediol |
| A2 | 38.1 | 37.6 | Terephthalic acid and trimellitic anhydride | Adducts of bisphenol A with ethylene oxide and propylene oxide |
| A3 | 26.0 | 22.9 | Maleic acid, succininc acid and trimellitic anhyderide | 1,4-butanediol and 1,6-hexanediol |
| A4 | 25.6 | 30.4 | Maleic acid and succininc acid | 1,4-butanediol and 1,6-hexanediol |

-continued

| Polyester resin A | Acid value (mgKOH/g) | Hydroxyl value (mgKOH/g) | Acid unit | Alcoholic unit |
|---|---|---|---|---|
| A5 | 26.6 | 21.6 | Maleic acid and succininc acid | 1,4-butanediol and 1,6-hexanediol |
| A6 | 4.8 | 3.9 | Maleic acid and succininc acid | 1,4-butanediol and 1,6-hexanediol |
| A7 | 49.0 | 51.0 | Maleic acid and succininc acid | 1,4-butanediol and 1,6-hexanediol |

The X-ray diffraction spectra and DSC patterns of the polyester resins A1 and A2 are shown in FIGS. 1 to 4, respectively. The measuring conditions are mentioned above.

The evaluation results of the toners (developers) of Examples 1 to 8 and Comparative Example 1 are as follows.

TABLE 2

| | Gloss (%) | Offset resist | Low temp. fix-ability | Trans-fera-bility | Dura-bility | Pulver-izability | Charge sta-bility |
|---|---|---|---|---|---|---|---|
| Ex. 1 | 26 | ○ | ◎ | ○ | ○ | ○ | ○ |
| Comp. Ex. 1 | 49 | ○ | x | ○ | ○ | ○ | ○ |
| Ex. 2 | 23 | ◎ | ○ | ○ | ○ | ○ | ○ |
| Ex. 3 | 30 | Δ | ◎ | ○ | ○ | ○ | ○ |
| Ex. 4 | 29 | ○ | ○ | ○ | ○ | ○ | ○ |
| Ex. 5 | 27 | Δ | ◎ | ○ | ○ | ○ | ○ |
| Ex. 6 | 27 | ○ | ○ | ○ | ○ | ○ | ○ |
| Ex. 7 | 38 | ○ | ○ | ○ | ○ | ○ | ○ |
| Ex. 8 | 25 | Δ | ◎ | ○ | ○ | ○ | Δ |

Example 9

The procedure for preparation and evaluation of the toner in Example 1 was repeated except that the formula of the mother toner was changed to the following.

| | |
|---|---|
| Polyester resin (A1) | 10 |
| Polyester resin (B1) | 70 |
| Styrene-butyl acrylate (C2) | 15 |

(content of THF-insoluble components: 0%, weight average molecular weight: 15,000, glass transition temperature: 61° C., solubility parameter: 9.0, pulverizability: better than those of the resin (B1) and the carnauba wax) Carnauba wax subjected to

| | |
|---|---|
| free-fatty-acid removing treatment | 5 |

(melting point: 83° C., penetration: 1 mm, solubility parameter: 8.9)

| | |
|---|---|
| Charge controlling agent | 2 |

(a metal salt of a salicylic acid derivative) Colorant (Copper phthalocyanine blue pigment) 2.5

The resins A1, B1 and C2 are examples of the resins A, B and C in the present invention.

The maximum particle diameter of the resultant toner was 18 μm and the maximum long axis particle diameter of the wax included in the toner was 2 μm. In addition, when the cross section of the toner was observed with a transmission electron microscope, it was confirmed that the resin (C2) is dispersed like islands in the resin (B1), and the wax is included in the resin (C2).

The evaluation results are shown in Table 3.

Example 10

The procedure for preparation and evaluation of the toner in Example 1 was repeated except that the formula of the mother toner was changed to the following.

| | |
|---|---|
| Polyester resin (A1) | 10 |
| Polyester resin (B2) | 60 |

(content of THF-insoluble components: 0%, weight average molecular weight: 12,000, glass transition temperature: 59° C., solubility parameter: 10.8)

| | |
|---|---|
| Polyester resin (B3) | 10 |

(content of THF-insoluble components: 0%, weight average molecular weight: 48,000, glass transition temperature: 59° C., solubility parameter: 11.3)

| | |
|---|---|
| Styrene-butyl acrylate (C2) | 15 |

(content of THF-insoluble components: 0%, weight average molecular weight: 15,000, glass transition temperature: 61° C., solubility parameter: 9.0, pulverizability: better than those of the resins (B2) and (B3) and the carnauba wax mentioned below) Carnauba wax subjected to

| | |
|---|---|
| free-fatty-acid removing treatment | 5 |

(melting point: 83° C., penetration: 1 mm, solubility parameter: 8.9)

| | |
|---|---|
| Charge controlling agent | 2 |

(a metal salt of a salicylic acid derivative)

| | |
|---|---|
| Colorant (Copper phthalocyanine blue pigment) | 2.5 |

The resins A1, B2, B3 and C2 are examples of the resins A, B and C in the present invention.

The maximum particle diameter of the resultant toner was 18 μm and the maximum long axis particle diameter of the wax included in the toner was 2 μm. In addition, when the cross section of the toner was observed with a transmission electron microscope, it was confirmed that the resin (C2) is dispersed like islands in the mixture of the resins (B2) and (B3), and the wax is included in the resin (C2).

The evaluation results are shown in Table 3.

Example 11

The procedure for preparation and evaluation of the toner and developer in Example 1 was repeated except that 0.4 parts of a hydrophobized silica treated with hexamethyldisilazane and 0.6 parts of a hydrophobized titanium oxide treated with isobutyltrimethoxysilane were used as the external additive.

The evaluation results are shown in Table 3.

Example 12

The procedure for preparation and evaluation of the toner and developer in Example 1 was repeated except that the polyester resin (B1) was replaced with a polyol resin (B4).

The polyol resin (B4) is an example of the resin B in the present invention and had been prepared using a bisphenol A-form epoxy resin, a glycidyl compound of an adduct of a bisphenol A with ethylene oxide, bisphenol F and p-cumyl phenol. The properties of the resin (B4) are as follows:

(1) content of THF-insoluble components: 0%
(2) weight average molecular weight: 18,000
(3) glass transition temperature: 60° C.
(4) solubility parameter: 11.1

The maximum particle diameter of the resultant mother toner was 18 μm and the maximum long axis particle diameter of the wax included in the toner was 5 μm. In addition, when the cross section of the mother toner was observed with a transmission electron microscope, it was confirmed that the resin (C1) is dispersed like islands in the resin (B4), and the wax is included in the resin (C1).

The evaluation results are shown in Table 3

Example 13

The procedure for preparation and evaluation of the toner and developer in Example 1 was repeated except that the resin (C1) was replaced with a resin (C3) in which a styrene-butyl acrylate-acrylonitrile copolymer is grafted on a polyethylene wax. The resin C3 is an example of the resin C in the present invention.

The properties of the resin (C3) are as follows:

(1) content of THF-insoluble components: 0%
(2) weight average molecular weight: 15,000
(3) glass transition temperature: 63° C.
(4) solubility parameter: 10.2

The content of THF-insoluble components in this toner was 0%. The maximum particle diameter of the resultant toner was 18 μm and the maximum long axis particle diameter of the wax included in the toner was 1 μm. In addition, when the cross section of the toner was observed with a transmission electron microscope, it was confirmed that the resin (C3) is dispersed like islands in the resin (B1), and the wax is included in the resin (C3).

The evaluation results are shown in Table 3.

Example 14

The procedure for preparation and evaluation of the toner and developer in Example 13 was repeated except that the polyethylene wax was replaced with a synthetic ester wax.

The properties of the ester wax are as follows:

(1) melting point: 84° C.
(2) penetration: 1 mm
(3) solubility parameter: 8.8

The content of THF-insoluble components in this toner was 0%. The maximum particle diameter of the resultant toner was 18 μm and the maximum long axis particle diameter of the wax included in the toner was 0.7 μm. In addition, when the cross section of the toner was observed with a transmission electron microscope, it was confirmed that the resin (C3) is dispersed like islands in the resin (B1), and the wax is included in the resin (C3).

The evaluation results are shown in Table 3.

Example 15

The procedure for preparation and evaluation of the toner and developer in Example 1 was repeated except that 1.5 parts of a hydrophobized silica treated with hexamethyldisilazane and having a primary particle diameter of 0.02 μm and 3 parts of a particulate polymethyl methacrylate which had been prepared by a soap-free emulsion polymerization method and which has a primary particle diameter of 0.2 μm were further added to the mother toner as internal additives.

The evaluation results are shown in Table 3.

Example 16

The procedure for preparation and evaluation of the toner and developer in Example 11 was repeated except that 1.2 parts of a silica having a specific surface area of 35 $m^2/g$ were further added to the toner as an external additive.

The evaluation results are shown in Table 3.

Example 17

The procedure for preparation and evaluation of the toner and developer in Example 11 was repeated except that 2 parts of a particulate polymethyl methacrylate which had been prepared by a soap-free emulsion polymerization method and which has an average primary particle diameter of 0.2 μm were further added to the toner as an external additive.

The evaluation results are shown in Table 3.

Example 18

The procedure for preparation and evaluation of the toner and developer in Example 17 was repeated except that the wax was replaced with a polyethylene wax having a melting point of 88° C. and a penetration of 6.5 mm.

The content of THF-insoluble components in this toner was 0%. The maximum particle diameter of the resultant toner was 18 μm and the maximum long axis particle diameter of the wax included in the toner was 8 μm. In addition, when the cross section of the toner was observed with a transmission electron microscope, it was confirmed that the resin (C1) is dispersed like islands in the resin (B1), and the wax is included in the resin (C1).

The evaluation results are shown in Table 3.

Example 19

The procedure for preparation and evaluation of the toner and developer in Example 1 was repeated except that the polyester resin (B1) was replaced with a low molecular weight polyester resin (B5) The resin B5 is an example of the resin B in the present invention.

The properties of the polyester resin (B5) are as follows.

(1) content of THF-insoluble components: 0%
(2) weight average molecular weight: 7000
(3) glass transition temperature: 60° C.
(4) solubility parameter: 10.8

The maximum particle diameter of the resultant toner was 18 μm and the maximum long axis particle diameter of the wax included in the toner was 8 μm. In addition, when the cross section of the toner was observed with a transmission electron microscope, it was confirmed that the resin (C1) is dispersed like islands in the resin (B5), and the wax is included in the resin (C1).

The evaluation results are shown in Table 3.

Example 20

The procedure for preparation and evaluation of the toner and developer in Example 1 was repeated except that the polyester resin (B1) was replaced with a low molecular weight polyester resin (B6) The resin B6 is an example of the resin B in the present invention.

The properties of the polyester resin (B6) are as follows.

(1) content of THF-insoluble components: 2%
(2) weight average molecular weight: 100,000
(3) glass transition temperature: 61° C.
(4) solubility parameter: 10.8

The maximum particle diameter of the resultant toner was 18 μm and the maximum long axis particle diameter of the wax included in the toner was 8 μm. In addition, when the cross section of the toner was observed with a transmission electron microscope, it was confirmed that the resin (C1) is dispersed like islands in the resin (B6), and the wax is included in the resin (C1).

The evaluation results are shown in Table 3.

Comparative Example 2

The procedure for preparation and evaluation of the toner and developer in Example 1 was repeated except that the styrene-methyl methacrylate resin (C1) was not added.

The maximum particle diameter of the resultant toner was 18 μm and the maximum long axis particle diameter of the wax included in the toner was 9 μm. In addition, when the cross section of the toner was observed with a transmission electron microscope, it was confirmed that the wax is dispersed like islands in the resin (B1) and the particle diameter of the wax is larger than that of the wax in the toner of Example 1.

The evaluation results are shown in Table 3.

Comparative Example 3

The procedure for preparation and evaluation of the toner and developer in Example 1 was repeated except that the formula of the mother toner was changed to the following.

| | |
|---|---|
| Polyester resin (A1) | 10 |
| Polyester resin (B1) | 55 |
| Styrene-methyl acrylate (C1) | 15 |
| Polyethylene wax (melting point: 99° C., penetration: 1.5 mm, solubility parameter: 8.1) | 20 |
| Charge controlling agent (a metal salt of a salicylic acid derivative) | 2 |
| Colorant (Copper phthalocyanine blue pigment) | 2.5 |

The maximum particle diameter of the resultant toner was 18 μm and the maximum long axis particle diameter of the wax included in the toner was 10 μm. In addition, when the cross section of the toner was observed with a transmission electron microscope, it was confirmed that the resin (C1) is dispersed like islands in the resin (B1) and the wax is dispersed like islands in the resin (B1) and the resin (C1).

The evaluation results are shown in Table 3.

Comparative Example 4

The procedure for preparation and evaluation of the toner and developer in Example 1 was repeated except that the external additive was not added to the mother toner.

The results of evaluation of the toners of Examples 9 to 20 and Comparative Examples 2 to 4 are shown in Table 3.

TABLE 3

| | Gloss (%) | Low temp. fix-ability | Offset resist | Trans-fera-bility | Dura-bility | Pulver-izability | Charge sta-bility |
|---|---|---|---|---|---|---|---|
| Ex. 9 | 28 | ◎ | ○ | ◎ | ◎ | ○ | ○ |
| Ex. 10 | 28 | ◎ | ◎ | ◎ | ◎ | ○ | ○ |
| Ex. 11 | 25 | ◎ | ○ | ◎ | ○ | ○ | ◎ |
| Ex. 12 | 26 | ◎ | ○ | ○ | ○ | ○ | ○ |
| Ex. 13 | 29 | ◎ | ○ | ◎ | ◎ | ○ | ○ |
| Ex. 14 | 27 | ◎ | ○ | ◎ | ◎ | ○ | ○ |
| Ex. 15 | 26 | ◎ | ○ | ◎ | ◎ | ○ | ○ |
| Ex. 16 | 24 | ◎ | ○ | ◎ | ◎ | ○ | ◎ |
| Ex. 17 | 22 | ◎ | ○ | ◎ | ◎ | ○ | ◎ |
| Ex. 18 | 22 | ◎ | ○ | ○ | ○ | ○ | ◎ |
| Ex. 19 | 53 | ◎ | Δ | ○ | ○ | ○ | ○ |
| Ex. 20 | 1.2 | ◎ | ◎ | ○ | ○ | Δ | ○ |
| Comp. Ex. 2 | 41 | ◎ | ○ | x | x | x | x |
| Comp. Ex. 3 | 16 | Δ | ◎ | x | x | ○ | ○ |
| Comp. Ex. 4 | 27 | ◎ | ○ | x | x | ○ | ○ |

Effects of the Present Invention

As mentioned above, a color toner is provided which includes toner particles including a colorant, a binder resin, and a wax, and an external additive including at least one of an inorganic particulate material and a particulate resin, wherein the binder resin includes a polyester resin (A) having a crystallinity and the following formula (1):

$$(\text{—O—CO—CR1=CR2—CO—O—}(CH_2)_n\text{—})_m \quad (1)$$

wherein R1 and R2 independently represents a hydrocarbon, and n and m are repeating numbers. By using a polyester resin having a sharp molecular weight distribution and including low molecular weight components in an amount as much as possible, as the polyester resin (A), the resultant toner has good low temperature fixability and can produce images having a proper gloss.

In addition, not only the polyester resin (A) but also at least two kinds of resins (a resin (B) and a resin (C)) are included in the toner, while the resins (B) and (C) and the wax have an island-sea structure such that the resin (C) is present like islands in a sea of the resin (B) and the wax is substantially included in the resin (C). Therefore, the amount of the wax present on the surface of the toner particles can be decreased. Accordingly, the total amount of the wax can be increased, and thereby the toner has improved offset resistance while maintaining good transferability and durability. In addition, the pulverizability of the toner can be improved, and therefore a toner having a small average particle diameter can be effectively produced.

When the resin (B) has a weight average molecular weight of from 10,000 to 90,000, the resultant toner can produce images having proper gloss and good color reproducibility. In addition, since the toner includes the above-mentioned external additive, the toner has good transferability and durability.

When the resin (B) is a polyester resin and/or a polyol resin, the resultant toner can produce images having proper gloss and good color reproducibility while having good offset resistance.

When the resin (C) has a weight average molecular weight of from 10,000 to 60,000, the resultant toner can produce images having proper gloss and good color reproducibility while having good offset resistance.

When the resin (C) is a wax on which a vinyl resin is grafted, the wax in the toner is finely dispersed in the resin (C), and therefore the resultant toner has improved transferability and durability because the amount of the wax present on the surface of the toner particles can be further decreased.

When the maximum long axis particle diameter of the wax dispersed in the toner is not less than 0.5 μm and not greater than ⅓ of the maximum particle diameter of the toner, the resultant toner exhibits a good combination of offset resistance, transferability and durability.

When the wax has a melting point of from 70 to 125° C. and a penetration not greater than 5 mm, the resultant toner exhibits a good combination of offset resistance, transferability and durability.

When the toner includes a particulate inorganic material and/or a particulate organic material as internal additives, the toner has good transferability and durability.

When the toner includes the polyester resin (A) in an amount of from 1 to 50% by weight, deterioration of the low temperature fixability and hot offset resistance can be prevented.

When the polyester resin (A) has a glass transition temperature and a $F_{1/2}$ temperature of from 80 to 130° C., the resultant toner exhibits a good combination of high temperature preservability and low temperature fixability.

When the polyester resin (A) includes an alcohol unit obtained from a diol compound, and an acid unit obtained from an acid selected from maleic acid, fumaric acid, succinic acid and derivatives thereof, the resultant toner has good low temperature fixability.

When the diol compound is one of 1,4-butanediol, 1,6-hexanediol, and derivatives thereof, the resultant toner has good low temperature fixability.

When the polyester resin (A) has an acid value of from 20 to 45 mgKOH/g, the resultant toner has good low temperature fixability.

When the polyester resin (A) has a hydroxyl value of from 5 to 50 mgKOH/g, the resultant toner has good low temperature fixability.

When the polyester resin (A) has an X-ray diffraction spectrum in which peaks are observed at Bragg (2θ) angles of from 19° to 20°, from 21° to 22°, from 23° to 25°, and from 29° to 31°, the resultant toner has good low temperature fixability.

When the polyester resin (A) has a weight average molecular weight (Mw) of from 5,500 to 6,500, a number average molecular weight (Mn) of from 1,300 to 1,500, and a ratio Mw/Mn of from 2 to 5, the resultant toner has good low temperature fixability.

By using the toner mentioned above for an image forming method and apparatus (including a process cartridge), images having good image qualities can be stably produced for a long period of time with hardly causing the offset problem.

This document claims priority and contains subject matter related to Japanese Patent Applications Nos. 2002-151307 and 2003-124472, filed on May 24, 2002 and Apr. 28, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A color toner comprising:

toner particles comprising:

a colorant;

a binder resin; and a wax, and an external additive comprising at least one of an inorganic particulate material and a particulate resin, wherein the binder resin includes:

a polyester resin (A) having a crystallinity and the following formula (1):

$$(\text{—O—CO—CR1=CR2-CO—O—}(CH_2)_n\text{—})_m \quad (1)$$

wherein R1 and R2 independently represents a hydrocarbon, and n and m are repeating numbers;

a resin (B); and a resin (C), wherein each of the resins (A), (B) and (C) and the wax is insoluble in the others, wherein the resins (B) and (C) and the wax have an island-sea structure such that the resin (C) is present like islands in a sea of the resin (B) and the wax is substantially included in the resin (C).

2. The color toner according to claim 1, wherein the resin (B) has a weight average molecular weight of from 10,000 to 90,000.

3. The color toner according to claim 1, wherein the resin (B) comprises at least one of a polyester resin and a polyol resin.

4. The color toner according to claim 1, wherein the resin (C) has a weight average molecular weight of from 10,000 to 60,000.

5. The color toner according to claim 1, wherein the resin (C) comprises a wax, on which a vinyl resin is grafted.

6. The color toner according to claim 1, wherein the wax dispersed in the resin (C) has a maximum long axis particle diameter not less than 0.5 μm and not greater than ⅓ of a maximum particle diameter of the toner.

7. The color toner according to claim 1, wherein the wax has a melting point of from 70 to 125° C. and a penetration not greater than 5 mm.

8. The color toner according to claim 1, wherein the toner particles further comprises at least one of an inorganic particulate material and a particulate resin therein as internal additives.

9. The color toner according to claim 1, wherein the polyester resin (A) is included in the toner in an amount of from 1% to 50% by weight based on total weight of the toner.

10. The color toner according to claim 1, wherein the polyester resin (A) has a glass transition temperature of from 80 to 130° C. and a $F_{1/2}$ temperature of from 80 to 130° C.

11. The color toner according to claim 1, wherein the polyester resin (A) comprises an alcohol unit obtained from a diol having 2 to 6 carbon atoms and an acid unit obtained from an acid selected from the group consisting of maleic acid, fumaric acid, succinic acid and derivatives thereof.

12. The color toner according to claim 11, wherein the diol is one of 1,4-butane diol, 1,6-hexane diol and derivatives thereof.

13. The color toner according to claim 1, wherein the polyester resin (A) has an acid value of from 20 to 45 mgKOH/g.

14. The color toner according to claim 1, wherein the polyester resin (A) has a hydroxyl value of from 20 to 45 mgKOH/g.

15. The color toner according to claim 1, wherein the polyester resin (A) has an X-ray diffraction spectrum in which a diffraction peak is observed at Bragg (2θ) angles of from 19°to 20°, from 21° to 22°, from 23° to 25°, and from 29 to 31°.

16. The color toner according to claim 1, wherein the polyester resin (A) has a weight average molecular weight (Mw) of from 5,500 to 6,500, a number average molecular weight (Mn) of from 1,300 to 1,500, and a ratio (Mw/Mn) of from 2 to 5.

17. A toner container containing the color toner according to claim 1.

18. An image forming method comprising:

developing an electrostatic latent image on an image bearing member with a developer comprising the color toner according to claim 1 to form a toner image thereon; and transferring the toner image onto a receiving material.

* * * * *